US006596989B2

(12) United States Patent
Kato

(10) Patent No.: US 6,596,989 B2
(45) **Date of Patent: *Jul. 22, 2003**

(54) MASS ANALYSIS APPARATUS AND METHOD FOR MASS ANALYSIS

(75) Inventor: Yoshiaki Kato, Mito (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/135,674

(22) Filed: May 1, 2002

(65) Prior Publication Data

US 2002/0125425 A1 Sep. 12, 2002

Related U.S. Application Data

(62) Division of application No. 09/549,470, filed on Apr. 14, 2000, now Pat. No. 6,469,297.

(30) Foreign Application Priority Data

Apr. 15, 1999 (JP) ..... 11-107534

(51) Int. Cl.[7] ..... H01J 49/04
(52) U.S. Cl. ..... 250/288; 250/285
(58) Field of Search ..... 250/288, 285, 250/281, 282

(56) References Cited

U.S. PATENT DOCUMENTS

| | | | | |
|---|---|---|---|---|
| 5,073,713 | A | 12/1991 | Smith et al. | 250/282 |
| 5,559,337 | A | 9/1996 | Ito et al. | 250/288 |
| 5,936,242 | A | 8/1999 | De La Mora et al. | 250/288 |
| 6,066,848 | A | 5/2000 | Kassel et al. | 250/288 |
| 6,191,418 | B1 | 2/2001 | Hindsgaul et al. | 250/288 |
| 6,207,954 | B1 | 3/2001 | Andrien, Jr. et al. | 250/288 |
| 6,469,297 | B1 * | 10/2002 | Kato | 250/288 |

OTHER PUBLICATIONS

"A New Approach for the Study of Gas–Phase Ion–Ion Reactions Using Electrospray Ionization", Journal of American Society for Mass Spectrometry, vol. 3 (1992), pp. 695–705.

* cited by examiner

*Primary Examiner*—Kiet T. Nguyen
(74) *Attorney, Agent, or Firm*—Kenyon & Kenyon

(57) ABSTRACT

A mass analysis apparatus is capable of performing a plurality of measurements in parallel by mounting a plurality of ion sources onto one mass spectrometer and speedily switching the ion sources. The mass analysis apparatus comprises a plurality of ion sources; and a deflecting means for deflecting ions from at least one ion source among the plurality of ion sources so that the ions travel toward the mass spectrometer by producing an electric field.

10 Claims, 28 Drawing Sheets

MASS ANALYSIS APPARATUS AND METHOD FOR MASS ANALYSIS

CROSS-REFERENCE TO RELATED APPLICATIONS

This application is a divisional of U.S. Ser. No. 09/549,470, filed on Apr. 14, 2000 now U.S. Pat. No. 6,469,297.

BACKGROUND OF THE INVENTION

1. Field of the Invention

The present invention relates to a mass analysis apparatus and, more particularly to a mass analysis apparatus suitable for improving measuring efficiency and for increasing volume of information obtainable per unit time.

2. Description of the Prior Art

Analyzers such as a mass spectrometer direct-coupled to a gas chromatograph (GC/MS), a mass spectrometer direct-coupled to a liquid chromatograph (LC/MS), a plasma-ionization mass spectrometer (plasma-ionization MS) and the like have been widely used in the fields of environmental science, medical since, pharmacy and so on.

The GC/MS and the LC/MS are used for qualitative and quantitative analysis of an extremely small amount of an organic chemical compound, and the plasma-ionization MS is used for qualitative and quantitative analysis of a small amount of metal. The GC/MS or the LC/MS is an analyzer which is formed by coupling a mass spectrometer (MS) to a gas chromatograph or a liquid chromatograph, respectively. The plasma-ionization MS is an analyzer which is formed by coupling a mass spectrometer (MS) to a plasma ion source operable under atmospheric pressure.

The LC/MS is composed of the liquid chromatograph, an atmospheric pressure ion source, a data processor and so on. The mass spectrometer (MS) requires a high vacuum higher than $10^{-3}$ Pa. On the other hand, the LC is an apparatus in which liquid such as water, an organic solvent or the like is handled under atmospheric pressure ($10^5$ Pa). Therefore, the two units are not compatible with each other, and accordingly it has been difficult to couple them together. However, the LC/MS becomes practical due to progress of the vacuum technology and development of the atmospheric pressure ion source. FIG. 31 a schematic view showing a common LC/MS.

Measurement using the LC/MS is generally performed according to the following procedure.

A sample is automatically injected by an auto-sampler 12 into a mobile phase transferred by a pump 11. The sample is separated into components each by a separation column 13. Each of the separated components is introduced into an atmospheric pressure ion source 20 of the LC/MS. The introduced component is ionized by the atmospheric pressure ion source 20. The produced ions are introduced into a high vacuum chamber 80 evacuated by a turbo-molecular pump 26 through an intermediate pressure chamber 21 evacuated by an oil rotary pump 22. The ions are mass-analyzed by a mass spectrometer 82 placed in the high vacuum chamber 80 to be detected by a detector 83 as an ion current. Finally, a mass spectrum or a mass chromatogram is obtained by a data processor 84.

In a case of common LC/MS measurement, the required time for measuring one sample from starting of introducing the sample to completion of analysis is approximately one hour. The reason is that separation time (approximately 30 minutes) is required in the first place. Further, in the LC analysis there is gradient analysis in which the component of the mobile phase is changed with time. In that case, the time (20 to 30 minutes) for returning the component of the mobile phase to the original state is necessary. Consequently, the sample measuring cycle becomes approximately one hour. Therefore, number of measured samples per day per one LC/MS becomes only 20 to 30.

As the ion source of the LC/MS, an atmospheric pressure chemical ionizer ion source (APCI), an electro-spray ion source (ESI), and a sonic spray ion source (SSI) are widely used in the present time. The APCI is suitable for ionizing neutral or weak polar chemical compounds, and the ESI or the SSI is suitable for ionizing high polar or ionic chemical compounds. These ionizers provide complimentary information. Further, obtainable information is different depending on the polarity (positive, negative) of ionization. In order to extract various kinds of information as much as possible from the LC/MS analysis of one sample, an operator of the LC/MS frequently switches the ion source (ESI, APCI, SSI), switches the polarity of ionization, and changes analysis conditions such as the mobile phase, the column and so on.

Among them, a widely employed method of switching the ion source is performed by taking a mounted ion source off by hand and mounting a new ion source. The reason is that the structures of the ion sources, the ESI, the APCI and the SSI, are largely different. The switching of the ion source requires large amounts of work and working time, as to be described below.

The switching of the ion source comprises the steps of initially stopping operation of the LC and the ion source; waiting until temperature of the ion source returns to room temperature; taking the ion source off; mounting the new ion source; switching on the power supply of the ion source to heat the ion source; performing conditioning by making the mobile phase flow through the LC column; and performing calibration and the like using a standard sample.

As described above, the switching of the ion source requires a large amount of procedures, work, time and labor. Many operators sometime try to analyze all of samples using one mounted ion source to avoid the troubles described above. As a result, a negative analysis result is often obtained. This means that although at least six different kinds of data (three kinds of ion sources×positive and negative spectra=3×2=6) for one sample may be obtained in the LC/MS analysis if measurement is performed using the three kinds of ion sources, the operator abandons the possibility for himself. Of course, the whole analysis can not be automated because the switching of the ion source is performed by hand.

Various methods of easily switching a plurality of ion sources have been proposed in order to solve the problem of lack of processing ability of the LC/MS.

A mechanism capable of easily switching the ion source between an APCI and an ESI is disclosed in Japanese Patent Application Laid-Open No.7-73848. A large rotatable table is disposed in an ion source portion of the LC/MS unit, and the two ion sources of the ESI and the APCI are mounted on the rotatable table. Switching between the ESI and the APCI is performed by rotating the rotatable table. In this method, the trouble of switching the ion source can be simplified, but the time for analysis can not be shortened because the analyses of the APCI and the ESI have to be performed in series. Of course, the time for conditioning can not be shortened. Further, Japanese Patent Application Laid-Open No.7-73848 does not describe any method of shortening the time for work to cope with the variety of measurement (switching of the ionization method, switching of positive/ negative polarity). It does not describe any technology for improving the measurement efficiency per unit time either.

Another technology of connecting a mass spectrometer to a plurality of ion sources is described in Journal of American Society for Mass Spectrometry, Vol. 3 (1992), pp. 695–705. In this technology, ions produced in two atmospheric pressure ion sources are introduced into the mass spectrometer separately through two inlet ports of a Y-shaped capillary. By sampling the ions from one of the ion sources under atmospheric pressure, switching of the ion source can be performed without mechanically switching between the ion sources. However, the method has a large problem. While one of analyses is being performed, one of the two ion sources needs to be in operation and the other needs to be out of operation. In order to stop operation of an ion source, the power source to the ion source needs to be switched off, and the transferring of the mobile phase from the LC also needs to be stopped. The reason is that if the ions and neutral gas molecules of the LC solution are sucked through the two inlet ports of the Y-shaped capillary, the ions and the solution molecules are mixed in the midway of the Y-shaped capillary. Reaction between the ions and the solution molecules occurs there, and consequently a correct mass spectrum may not be obtained. However, it is impossible to stop operation of the LC while the LC analysis is being performed. Therefore, although the method can eliminate the mechanical trouble of switching the ion source, the measurement efficiency of the LC/MS analysis can not be improved.

FIG. 32 shows a conventional method in which one MS is coupled with two LCs. Separated components are sent out from the two LCs of LC 10 and LC 30 together with an eluent. The eluent is introduced into an atmospheric pressure ion source 20 through a switching valve 190 to obtain a mass spectrum by a mass spectrometer 82. Two LC flow paths can be switched by the switching valve 190 depending on necessity. An advantage of this method is that LC separation can be performed without stopping operation of both of one selected LC and the other LC. However, this method can not perform parallel analysis because the two LCs are difficult to be switched at a high speed. Of course, when objects to be analyzed are eluted from the LC 10 and the LC 30, only one of the objects eluted from one of the LCs can be analyzed. Further the LCs can not be switched at a high speed because the two eluents may be mixed inside the switching valve 190 and a connecting tube 34.

Japanese Patent Application Laid-Open No.6-215729 discloses an example of a mass analysis apparatus in which two kinds of LC ion sources and a GC ion source are combined. This apparatus has both functions of an LC/MS and a GC/MS which can be arbitrarily used by switching. Further, when the apparatus is used as the LC/MS, two kinds of ion sources can be used by switching voltage used for a deflector electrode. However, in this configuration, any means for removing a large amount of eluent flowing from the LC is not shown. Therefore, there is a large problem in that the two ion sources contaminate each other to increase the background level. Use of the GC/MS having a high sensitive ionization means and the LC/MS together may largely deteriorate the sensitivity of the GC/MS. That is, it is difficult to practically use the apparatus as an LC/MS and a GC/MS. In addition, it is impossible to performing measurements of the LC and the GC at a time. Furthermore, although the two kinds of ion sources can be used when the apparatus is used as the LC/MS, it is necessary to adjust axes of the deflector electrodes in order to effectively introduce the ions into the mass spectrometer because two pairs of the deflector electrodes are used. Furthermore, when the two kinds of ion sources are used at a time, the traveling path of an ion beam not used for analysis needs to be deflected to the outside of the mass spectrometer using the deflector electrode. The ions not introduced into the mass spectrometer collide against a wall inside the apparatus to contaminate the deflector electrode or generate secondary electrons, which causes noise. Therefore, although the apparatus can switch the ion source, the two sets of the ion sources are difficult to be used at a time.

On the other hand, the technology itself that ions are deflected by disposing an electrostatic deflector between an ion source and a mass spectrometer has been described in patents, papers and so on. An example of the mass analysis apparatus having a quadrupole deflector disposed between an atmospheric pressure ion source and a mass spectrometer is disclosed in Japanese Patent Application Laid-Open No.7-78590. In this apparatus, ions produced by the plasma ion source operable under atmospheric pressure are introduced into the mass spectrometer by the quadrupole deflector. By doing so, light and neutral fine particles produced by the plasma ion source are not incident to the mass spectrometer and the detector, and accordingly a high S/N ratio can be obtained. Therein, the quadrupole deflector is used only for deflecting in 90 degrees the ions produced in the one ion source, but the patent does not disclose any technology of switching of or parallel introducing of a plurality of ion sources.

An electrophoretic apparatus, an atmospheric pressure ion source (ESI) and a mass spectrometer are disclosed in U.S. Pat. No. 5,073,713. A quadrupole deflector is disclosed as one of components in this patent. The role of the quadrupole deflector is to improve the S/N ratio by separating ions produced in the ESI and introduced into a vacuum chamber from neutral fine particles. The patent does not disclose any technology of coupling with or switching of a plurality of ion sources.

The efficiency of LC/MS measurement has been improved by shortening of LC separation time and by automated measurement. However, in most of the LC/MSs, switching of the ion source has been still performed by hand. Further, even in a case where one mass spectrometer receives and sequentially processes components eluted from one LC, the time for separation by the LC and initialization of gradient elution is necessary. Therefore, the whole measurement time can not be shortened. On the contrary, the whole measurement time has been lengthened every time when number of measured samples and number of measured items are increased.

In recent yeas, as number of measured samples has been rapidly increased, the analyzers of this kind are required to have a high throughput. On the other hand, an analysis of water quality or the like needs wide variety of measurement techniques using analyzers such as a GC/MS, an LC/MS and a plasma ionization MS though the analysis of water quality belongs to a single measurement field. Accordingly, it is necessary to individually provide the analyzers for each of the analyses, which causes problems of raise in cost, necessity of wide space and so on. Therefore, the analyzers including a data processor are required to reduce their price, to deduce their size and to integrate them in a unit. However, none of the conventional technologies can not cope with these requirements.

SUMMARY OF THE INVENTION

In order to solve the problems described above, an object of the present invention is to provide a mass analysis apparatus which is capable of performing a plurality of measurements in parallel by mounting a plurality of ion sources onto one mass spectrometer and speedily switching the ion sources.

The present invention in order to attain the above-mentioned object is characterized by a mass analysis apparatus for performing mass analysis by introducing ions produced in an ion source into a mass spectrometer, which comprises a plurality of ion sources; and a deflecting means for deflecting ions from an arbitrary ion source among the plurality of ion sources so that the ions travel toward the mass spectrometer.

In detail, the above-mentioned deflecting means is an electrostatic deflector which is composed of two flat plate electrodes, or a quadrupole deflector which is composed of four electrodes.

According to the construction of the present invention, ions from a desired ion source can be selectively introduced into the mass spectrometer while the plurality of ion sources are producing ions. In the case of the construction using the electrostatic deflector, ions from all the ion sources can be introduced into the mas spectrometer at a time.

The ion sources applicable to the present invention are an electrospray ion source, an atmospheric pressure chemical ionization ion source, a sonic spray ion source, a coupling induction plasma ion source, a microwave induction ion source, an electron ionization ion source, a chemical ionization ion source, a laser ionization ion source, a laser ionization ion source, a glow discharge ion source, an FAB ion source and a secondary ionization ion source.

These ion sources can be used by combination irrespective of the kinds.

DESCRIPTION OF THE PREFERRED EMBODIMENTS (First Embodiment)

Figure 1:
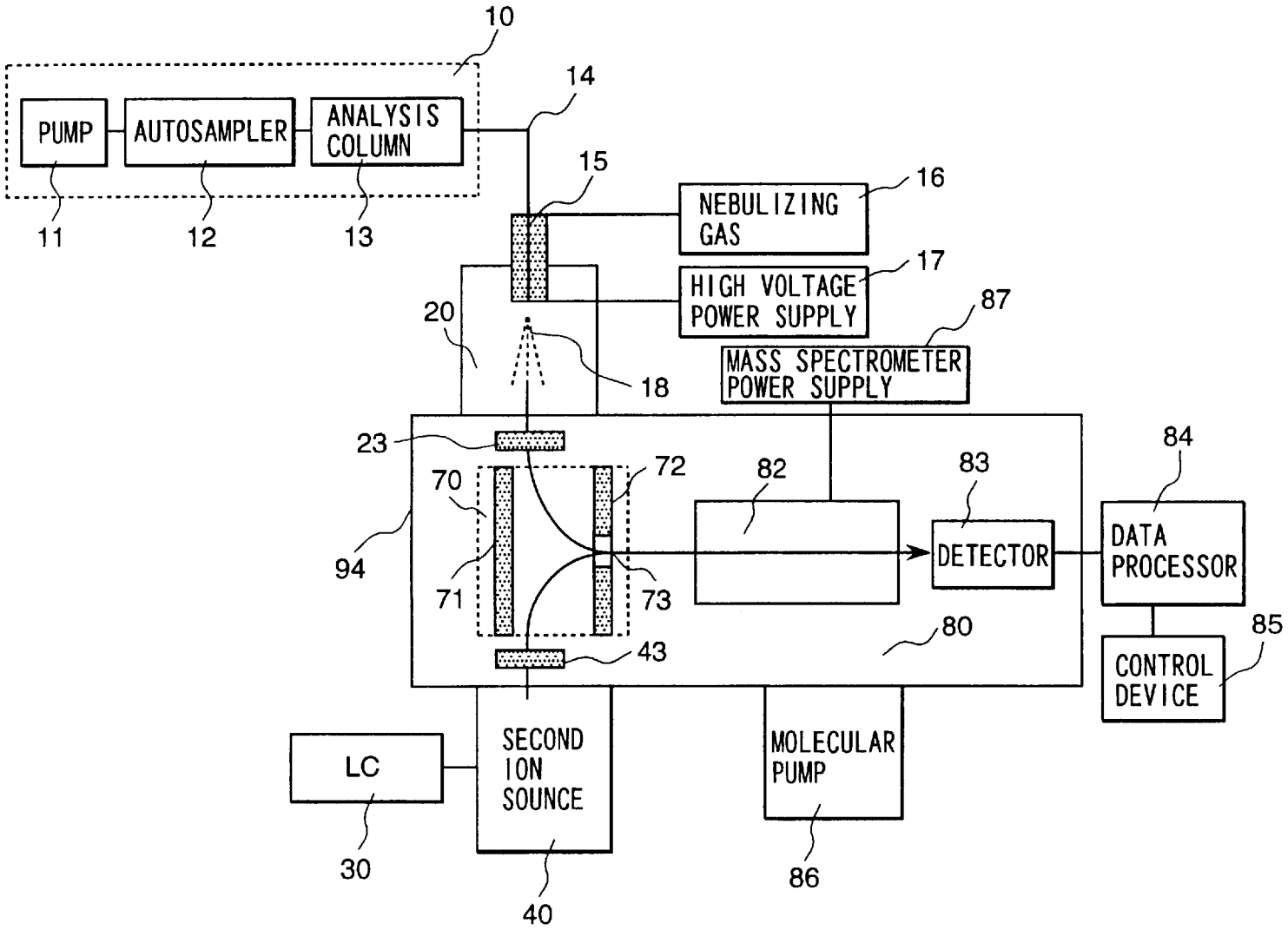
FIG. 1 is a block diagram showing the basic configuration of a first embodiment of an atmospheric pressure ionization LC/MS in accordance with the present invention.

FIG. 1 is a block diagram showing the basic configuration of a first embodiment of an atmospheric pressure ionization LC/MS apparatus in accordance with the present invention.

As shown in FIG. 1, in the atmospheric pressure ionization LC/MS apparatus, two liquid chromatographs (hereinafter, referred to as LC) are connected to one mass spectrometer (hereinafter, referred to as MS) individually through atmospheric pressure ion sources.

Here, description will be made on operation of the atmospheric pressure ionization LC/MS apparatus when a sample from one of the LCs is analyzed by the mass spectrometer.

In the LC 10, a mobile phase (eluent) is sent out from an eluent bottle by a pump 11 to be supplied to an auto-sampler 12. A sample liquid is injected into the eluent by the auto-sampler 12 to be introduced into an analysis column 13. The sample is separated into components each by the analysis column 13. The separated component is sent out from the analysis column 13 and introduced into a spray capillary 15 of a first ion source 20 under atmospheric pressure through a connection tube 14. A high voltage of approximately 3 kV to 6 kV supplied from a high voltage power supply 17 is applied to an end portion of the spray capillary 15. The sample liquid is sprayed as small droplets 18 having charge into a spray space 18 under atmospheric pressure by high speed spray gas 16 sprayed in a direction equal to the axial direction of the capillary and by a high electric field. The small droplets 18 are further atomized by colliding with gas molecules in the atmosphere, and finally, ions are discharged in the atmosphere.

The ions produced in the first ion source 20 are introduced into a vacuum chamber 80 evacuated by a vacuum pump 86, and accelerated by an ion acceleration voltage Va1 applied to an ion acceleration electrode 23 arranged inside the vacuum chamber 80. The ions travel in the vacuum, and are introduced into an electrostatic deflector 70 and deflected toward the right hand side by the electrostatic deflector 70, and then introduced into a mass spectrometer 82 by passing through a small through hole 73 opened in a second electrode of the electrostatic deflector. Therein, the ions are mass analyzed. The ions are detected by a detector 83, and a mass spectrum or a mass chromatogram is obtained by a data processor 84. A controller 85 is connected to the data processor 84 to control the liquid chromatograph, the atmospheric pressure ion source, the mass spectrometer and so on.

A second ion source 40 is attached at a position opposite to the first ion source 20 on a wall of a vacuum box 94 through the electrostatic deflector 70. The sample component sent from an LC 30 is sent to the second ion source 40 to be ionized. The ions are accelerated by an ion acceleration voltage Va2 applied to an ion acceleration electrode 43. The ions incident to the electrostatic deflector 70 are deflected toward the right hand side by the electric field inside the electrostatic deflector 70.

When the ions from the plurality of ion sources 20, 40 are incident to the electrostatic deflector 70 at a time, the two kinds of ions from the both ion sources are deflected and sent into the mass spectrometer 82 together through the small through hole 73. The mass spectrometer 82 mass analyzes the two kinds of ions introduced at a time without discriminating the kinds. As a result, integration of mass spectra by the plurality of ion source can be performed.

On the other hand, if the acceleration voltages Va1 Va2 applied to the acceleration electrodes 23 and 43 are controlled, respectively, it is possible to select one of the ions source from the plurality of ions sources and to send the ions from only the selected ion source into the mass spectrometer 82. That is, by setting the Va1 in ON state and the Va2 in OFF state (setting to the grounding electric potential), only the ions produced in the first ion source can be mass analyzed. On the contrary, by setting the Va1 in OFF state and the Va2 in ON state, only the ions produced in the second ion source can be mass analyzed. As a result, by selecting an electrode to be applied with the ion acceleration voltage (a specified ion source), it is possible to freely select a measured ion source at a time point.

Figure 2:
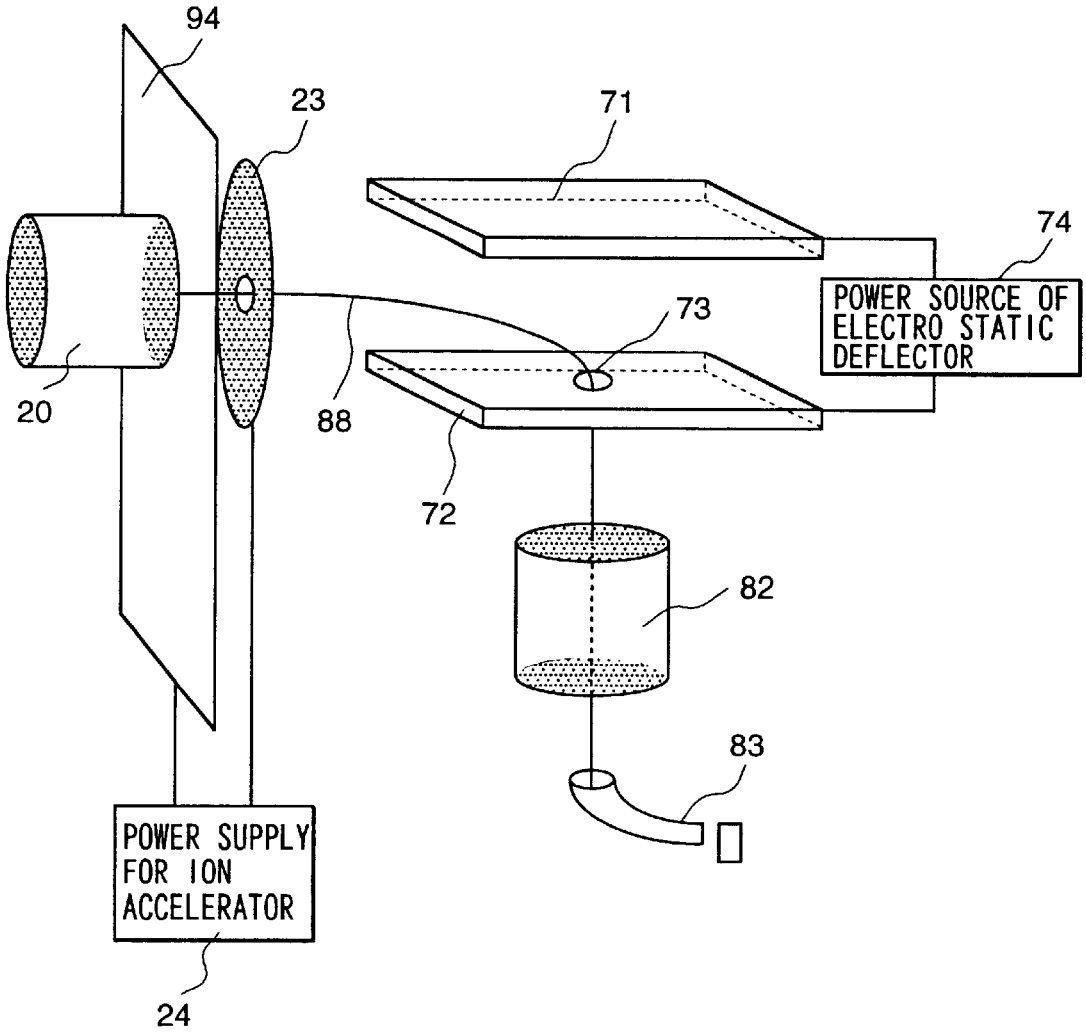
FIG. 2 is a view explaining an electrostatic deflector.

FIG. 2 is a schematic view showing the ion source 20, the electrostatic deflector 70 and so on used in the present embodiment.

The electrostatic deflector 70 is a component which is formed by assembling the circular or polygonal flat plate electrodes 71 and 72 in parallel and opposite to each other. The small through hole 73 is formed in the center of the second electrode 72 in the side of the mass spectrometer 82 out of the two electrodes. The two electrodes 71 and 72 are assembled through an insulator, and contained in the vacuum chamber 80 evacuated by the vacuum pump 86.

The ions produced in the first ion source 20 are accelerated by the ion acceleration voltage Va1 applied by the power supply 24 between the wall of the vacuum box 94 and the ion acceleration electrode 23. The ions accelerated by the ion acceleration electrode 23 travel in the vacuum and enter into the electrostatic deflector 70 to be deflected. The deflection is performed by applying a direct current voltage from a power supply 74 between the two electrodes 71 and 72 of the electrostatic deflector 70. Now, assuming that a positive ion beam 88 is incident from the ion acceleration electrode 23, the ions are deflected to go out toward the side of the mass spectrometer 82 through the small though hole 73 when a positive voltage +Vd1 is applied to the electrode 71 and a negative voltage −Vd2 is applied to the electrode 72. In a case where negative ions are incident, the ions can be easily introduced into the mass spectrometer 82 by applying a voltage having the reverse polarity.

As described above, the electrostatic deflector 70 can easily deflect ions.

Figure 3:
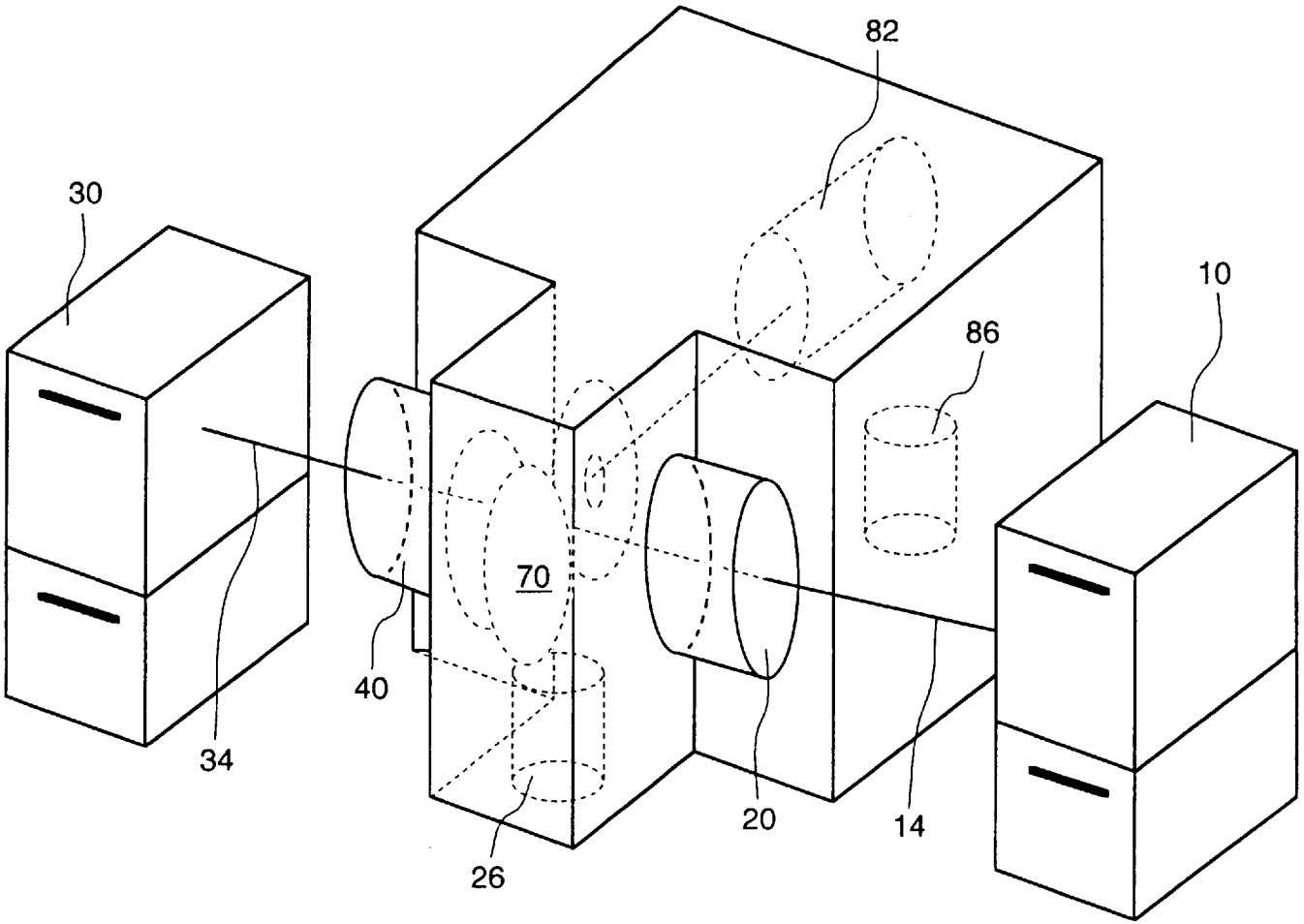
FIG. 3 is a view showing an outward appearance of the first embodiment in accordance with the present invention.

FIG. 3 shows the outward appearance of the present embodiment.

The eluent containing the sample component dent from the LC 10 is sent to the ion source 20 through the connecting tube 14. Similarly, the eluent from the LC 30 is sent to the second ion source 40 through the connecting tube 34.

Each of the two kinds of ions from these ion source can be selectively introduced into the electrostatic deflector 70 by switching on/off the ion acceleration voltage applied to each of the ion acceleration electrodes.

Figure 4:
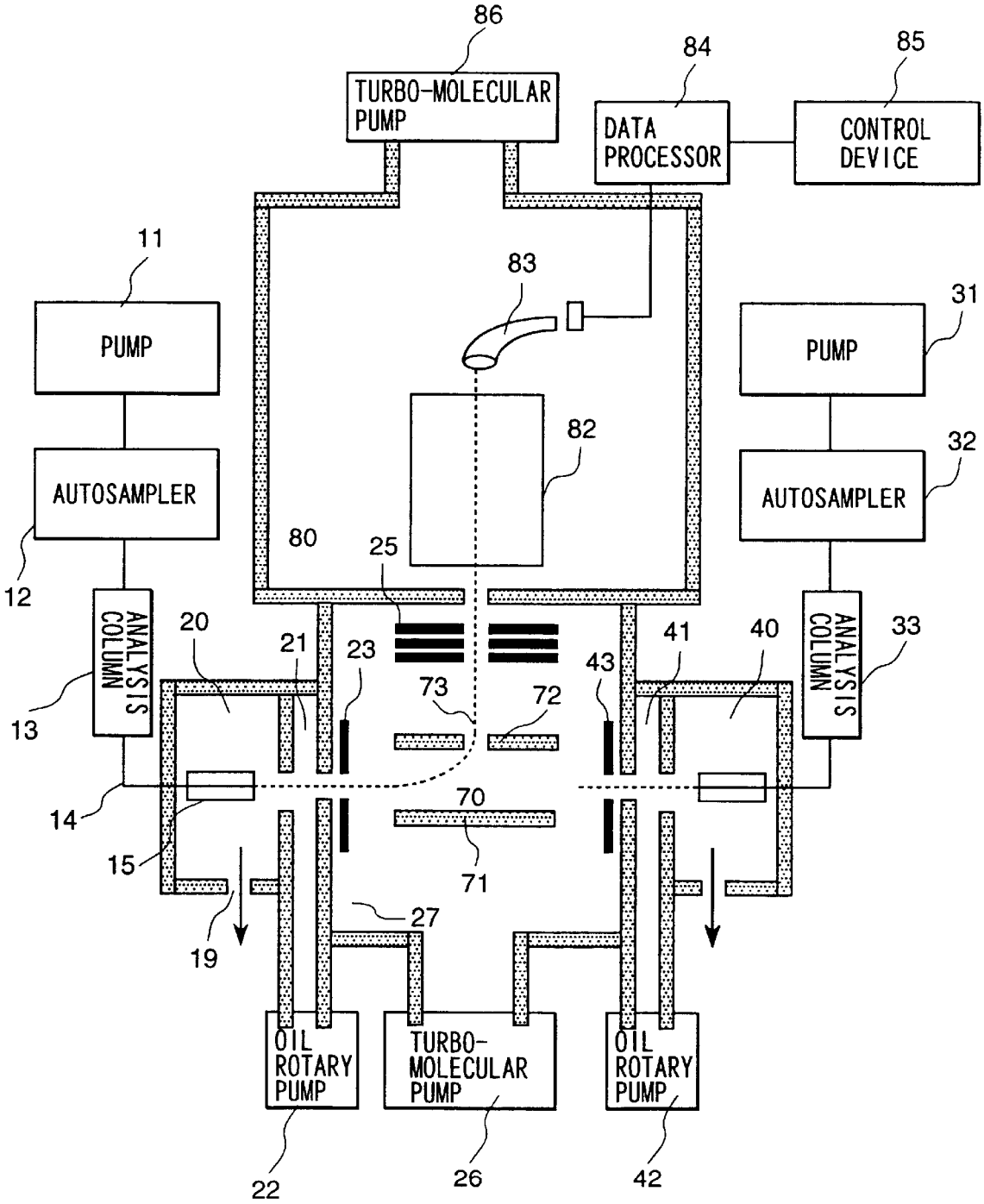
FIG. 4 is a schematic view showing the internal configuration of the first embodiment in accordance with the present invention.

FIG. 4 is a schematic view showing the detailed configuration of the LC/MS apparatus shown in FIG. 3.

The eluent transported from the pump 11 composing the first LC 10 is supplied to the auto-sampler 12. There, the sample is injected into the eluent and separated by the separation column 13. The sample separated into components each by the analysis column 13 is introduced into the atmospheric pressure ion source 20 through the connection tube 14. The sample liquid is sprayed as small, droplets having charge into the atmosphere from atomizer 15 applied with the high voltage. The small droplets traveling in the atmosphere along the electric field are further atomized by colliding with gas molecules in the atmosphere. Finally, ions are discharged in the atmosphere. The generated ions are introduced into a high vacuum chamber 27 evacuated by a turbo molecular pump 26 through an intermediate pressure chamber 21 evacuated by an oil rotary pump 22. There, the ions are accelerated by the ion acceleration voltage Va1 applied to the ion acceleration electrode 23, and are introduced into the electrostatic deflector 70. The ions are deflected by the electrostatic deflector 70, and go out through the small through hole 73 opened in the center of the second electrode 72 of the electrostatic deflector. The ion beam focused again by an Einzel lens 25 is introduced into another vacuum chamber 80 evacuated by a turbo molecular pump 86. Therein, the ions are mass analyzed by the mass spectrometer 82 placed inside the vacuum chamber 80, and detected by a detector 83 as an ion current. The data processor 84 arranges the data to provide a mass spectrum or a mass chromatogram. The controller 85 controls the LCs 10, 30, the ion sources 20, 40, the mass spectrometer 82 and so on based on the data processing.

On the other hand, the LC 30 is similarly composed of a pump 31, an auto-sampler 32, an analysis column 33 and so on. The sample is ionized by the second ion source 40. The generated ions are introduced into the vacuum chamber containing the ion acceleration electrode 43 and the electrostatic deflector 70 through an intermediate pressure chamber 41.

Therein, the introduction of the ions from the first ion source 20 and the second ion source 40 can be freely selected by controlling the voltages Va1, Va2 applied to the ion acceleration electrodes 23, 43.

Figure 5:
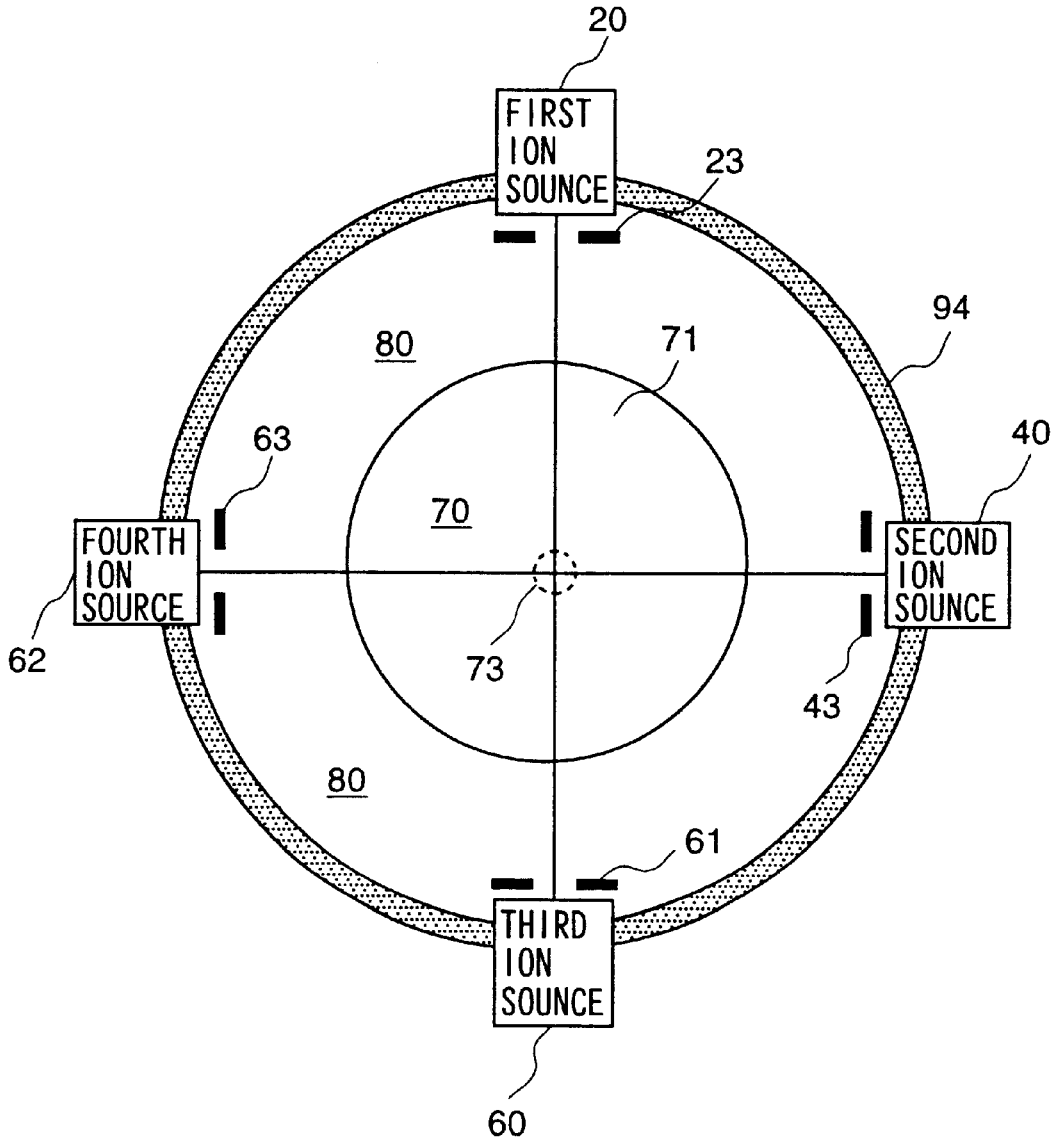
FIG. 5 is a view showing an example of a circular electrostatic deflector mounting four ion sources.

Although the example of mounting the two ion sources is described above, it is possible to mount more than two ion sources. FIG. 5 shows an arrangement example of ion sources in such a case.

A plurality of ion sources 20, 40, 60, 62 are arranged around the electrostatic deflector 70 as a center and fixed on a wall surface of the vacuum box 94. A small through hole which ions pass through is opened in the wall of the vacuum box 94. Actually, the ion sources are radially arranged with respect to the small through hole 73 of the electrostatic deflector 70 as the center. If the ions are introduced by being accelerated with an equal acceleration voltage, all the ions are equally deflected to be incident to the small through hole 73.

In a case where ions only from a specified ion source are selectively introduced into the mass spectrometer, the acceleration voltage applied to the ion source is controlled. For example, in a case of measuring the ions of the ion source 20, the acceleration voltage is applied to only the ion acceleration electrode 23, and voltage is not applied to all of the other ion acceleration electrodes 43, 61, 63.

Figure 7:
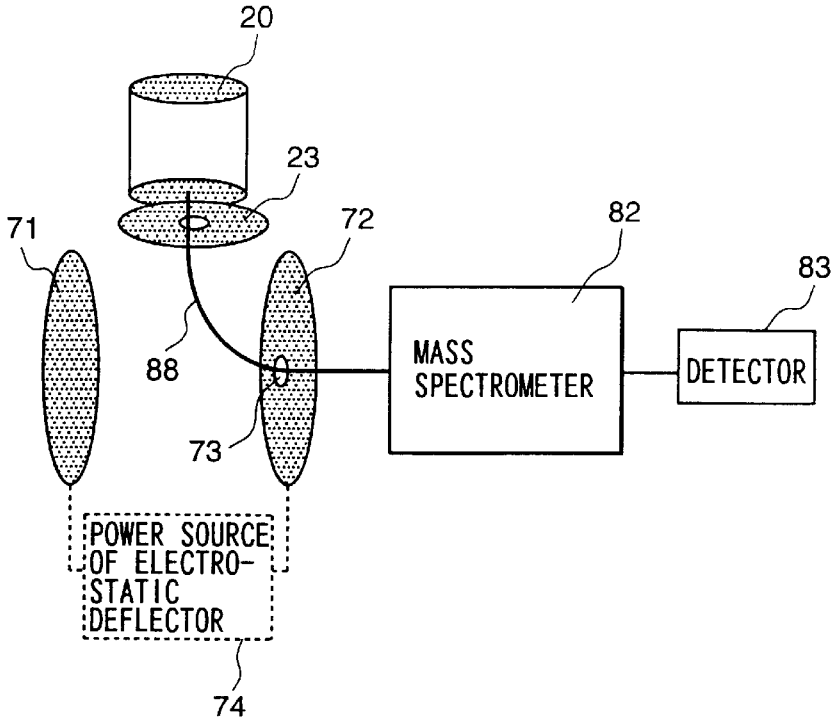
FIG. 7 is a view illustrating a feature of ion deflection in the structure of FIG. 5.
Figure 8:
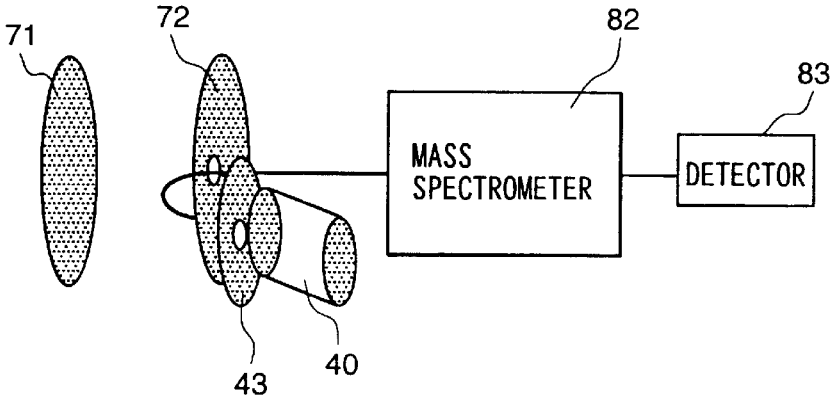
FIG. 8 is a view illustrating a feature of ion deflection in the structure of FIG. 5.
Figure 9:
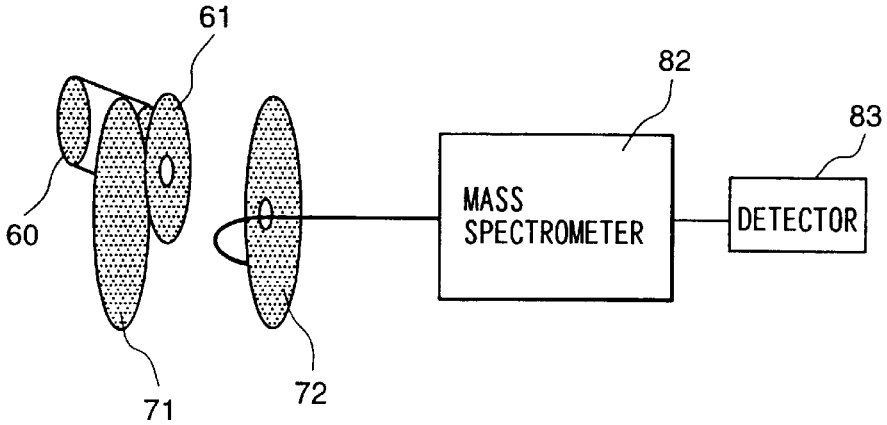
FIG. 9 is a view illustrating a feature of ion deflection in the structure of FIG. 5.

FIG. 7 to FIG. 9 are schematic views showing selection of one ion source. In FIG. 7, the acceleration voltage Va1 is applied to only the ion acceleration electrode 23. The ions of the other ion sources (not shown in the figure) are not accelerated, and accordingly not incident to the electrostatic deflector 70. Similarly, FIG. 8 shows an example of selecting the second ion source 40, and FIG. 9 shows an example of selecting the third ion source 60.

Further, in a case where ions from a plurality of ion sources are introduced into the mass spectrometer, acceleration voltages are applied to the ion acceleration electrodes of the plurality of ion sources at a time. For example, when ions of the ion sources 20 and 40 are required to be integrated, the ion acceleration voltages of the ion acceleration electrodes 23, 43 are switched on, and the ion acceleration voltages of the ion acceleration electrodes 61, 63 are switched off.

Figure 6:
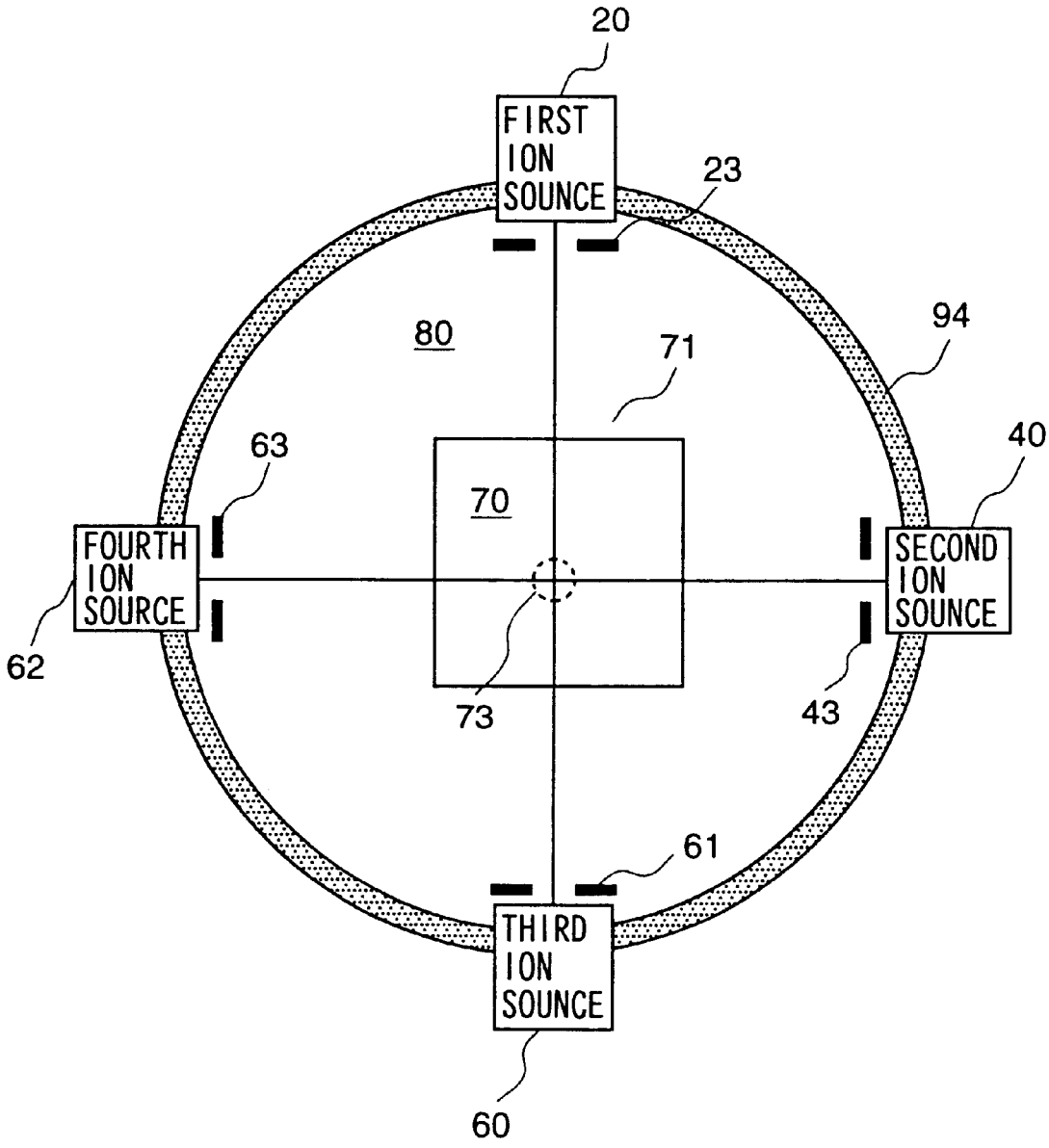
FIG. 6 is a view showing an example of a polygonal electrostatic deflector mounting four ion sources.

The ions of the selected ion sources are deflected and pass through the small through hole 73 to be sent into the mass spectrometer 82. (The ions travel horizontally with respect to the drawing, and receive a force vertical with respect to the drawing, and then pass through the small through hole 73 from a direction vertical with respect to the drawing.) The shape of the electrostatic deflector 70 may be circular as shown in FIG. 5 or polygonal as shown in FIG. 6.

In addition to the method of selecting ion sources that the ion acceleration voltages applied to the ion acceleration electrodes are ON/OFF, there are other methods.

Figure 10:
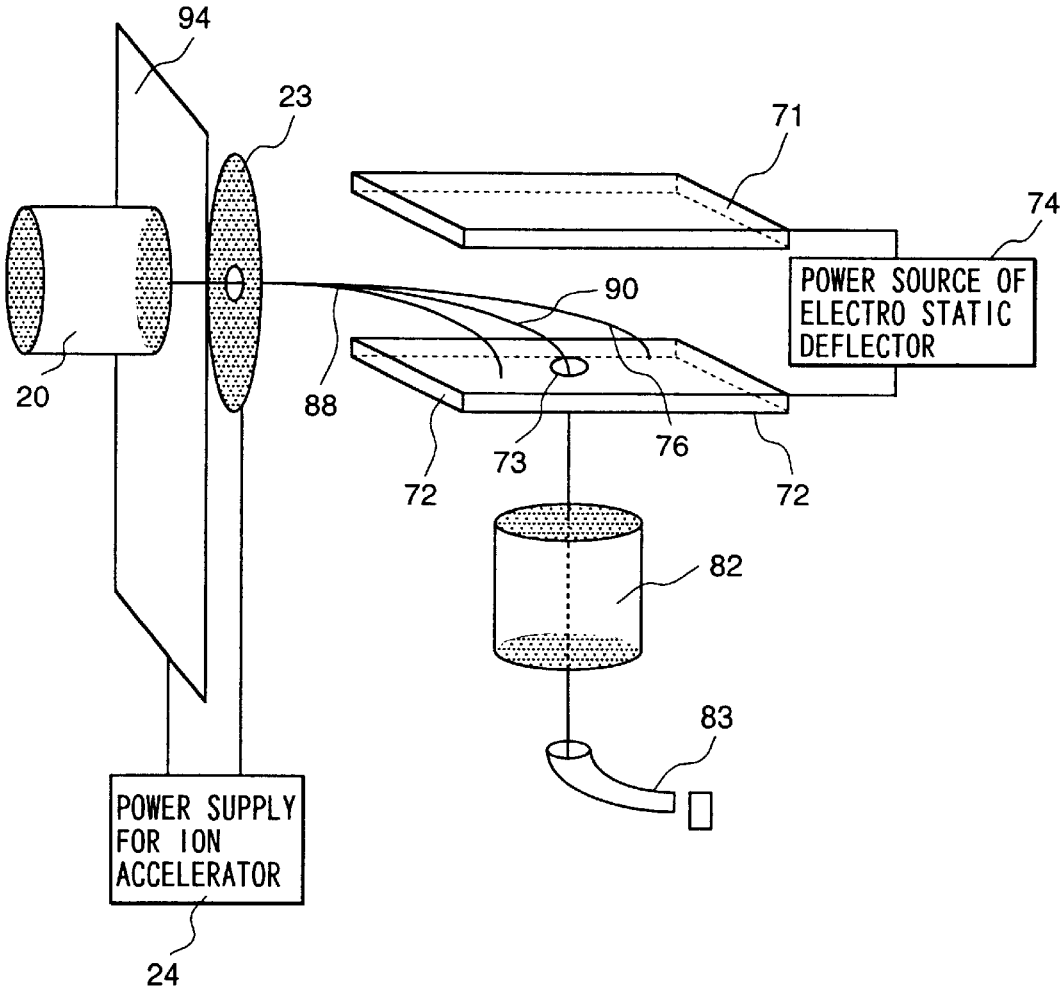
FIG. 10 is a view explaining the relationship between acceleration voltage of the ion acceleration electrode and electric field of the electrostatic deflector.

There is a strict relationship between the ion acceleration voltage Va (voltage between the wall of the vacuum box 94 and the ion acceleration electrode) and the deflection voltage Vd for allowing the ions pass through the small through hole 73 (voltage between the electrodes 71, 72). As shown in FIG. 10, an ion beam 76 accelerated by a high ion acceleration voltage Va is not sufficiently deflected by an electric field inside the electrostatic deflector 70, and accordingly reaches at a point beyond the small through hole 73. As a result, the ion beam 76 can not pass through the small through hole 73. On the other hand, when the ion acceleration voltage Va is low, the ion beam 75 is largely deflected by the electrostatic filed, and accordingly collides with the electrode 72 at a point in front of the small through hole 73. Therefore, the ion beam 75 can not pass through the small through hole 73.

That is, the relationship of Va/Vd=k is held between the ion acceleration voltage Va and the voltage Vd applied to the electrostatic deflector 70. Only one ion source can be selected by keeping the voltage Vd applied to the electrostatic deflector 70 to a constant value, by applying an accurate ion acceleration voltage (Va=k Vd) to only the one ion source, and by shifting the acceleration voltage applied to the other ion sources to a value (Va'≠k Vd).

On the contrary, a specified ion source can be selected by applying different ion acceleration voltages Va1, Va2, Va3, . . . to the ion acceleration electrodes of the individual ion sources, by selecting a voltage applied to the electrostatic deflector agreeing with the relationship Va=k Vd, and by applying the voltage to the electrostatic deflector when the specified ion source is selected. For example, when the second ion source 40 is selected, the Vd becomes Vd=k Va2.

Figure 11:
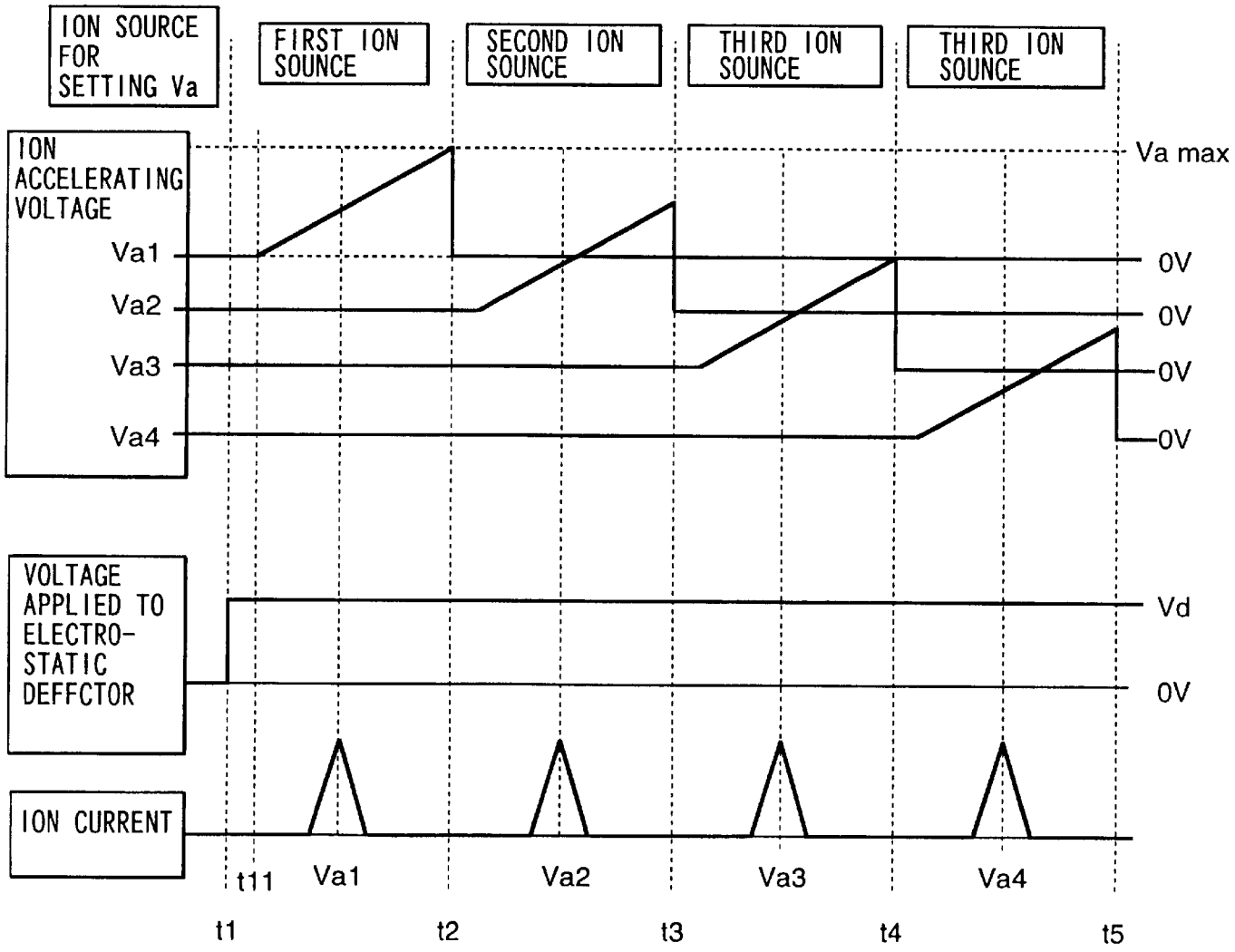
FIG. 11 is a chart explaining operation of obtaining an optimum applied voltage for the ion acceleration electrode.
Figure 12:
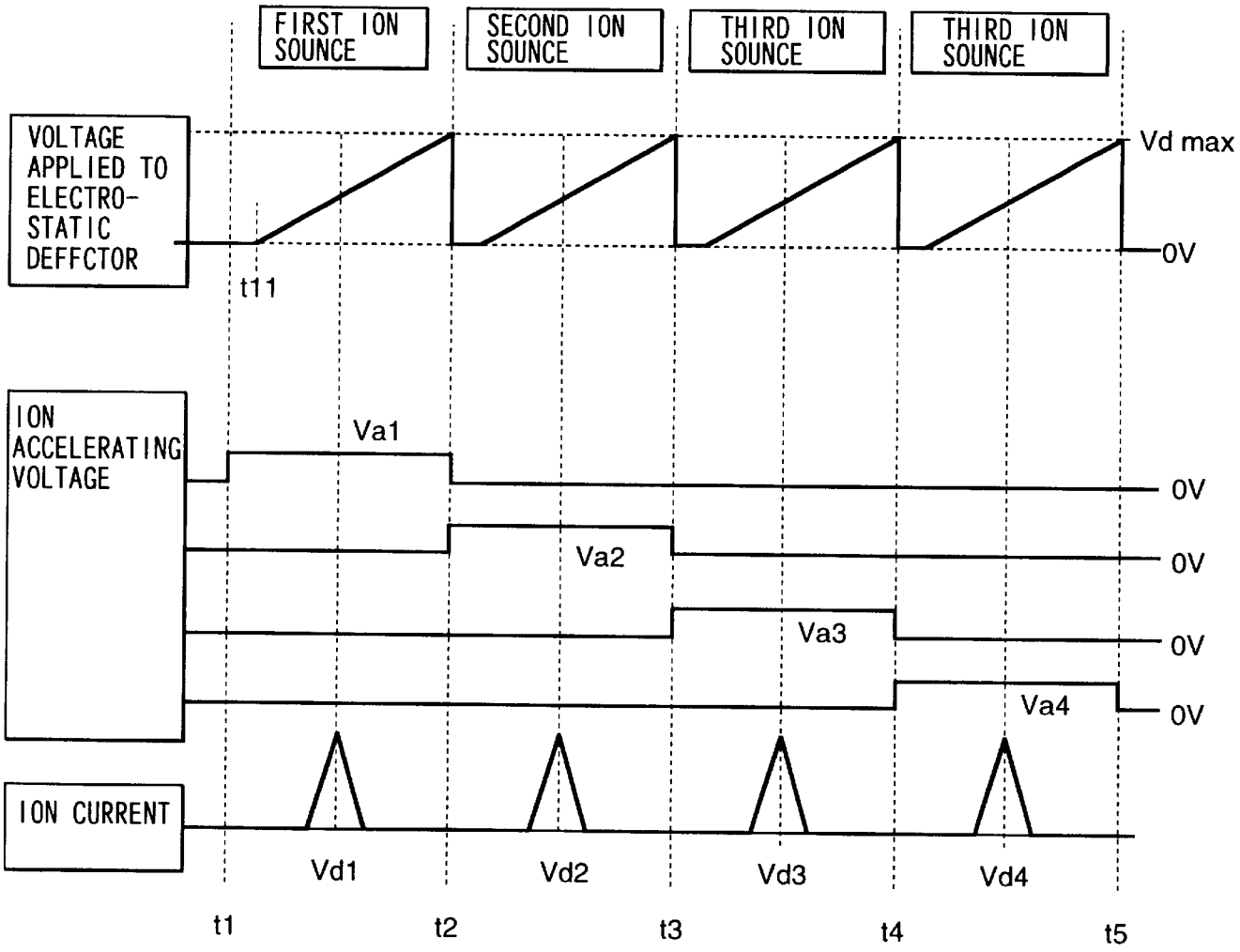
FIG. 12 is a chart explaining operation of obtaining an optimum applied voltage for the electrostatic deflector.

In an actual apparatus, because it is difficult to set the distance and the position between each of the ion source and the small through hole, and the incident angle of the ions to equal values, the value k can not be constant. Therefore, in prior to switching the ion source, the ion acceleration voltage Va and the voltage Vd applied to the electrostatic deflector need to be finely adjusted for each ion sources. The values are stored on the data processor 84, and set by transmitted a signal from the data processor 84 to each of the power supplies through the controller 85 The optimum values of Va, Vd can be automatically obtained without bothering the operator one by one. FIG. 11 and FIG. 12 are schematic charts showing the operation.

FIG. 11 shows the operating procedure for obtaining the optimum ion acceleration voltage Va for each of the ion sources when the voltage Vd applied to the electrostatic deflector 70 is set to a constant value. The procedure is described below.

(1) Each of the ion sources is brought in an operating state.
(2) At time t1, the voltage Vd applied to the electrostatic deflector 70 is applied,
(3) All the ion acceleration voltages Va to the first, the second, the third . . . ion sources are set to the grounding potential.
(4) After a short waiting time t11, the acceleration voltage Va1 for the first ion source is swept. Therein, it is sufficient to sweep over the range Va1±10% not from zero if there is data on the value Va1 at the precedent measurement, which can save time. An amount of total ions or an ion current value of a specified ion is measured using the mass spectrometer 82 while sweeping.
(5) A point at which the ion current value becomes maximum is the optimum value of the ion acceleration voltage Va1. That is, a point Va1 in which the ions passed through the small through hole 73 becomes maximum can be obtained. The acceleration voltage at that time is stored in the data processor 84.
(6) Similarly, the values Va2, Va3, . . . for the second, the third, . . . ion sources are obtained. By doing so, the optimum acceleration voltages Va for the ion sources are determined, and selection of the ion source can be performed by the data processor 84.

FIG. 12 shows the operating procedure for obtaining the optimum voltage Vd applied to the electrostatic deflector for each of the ion sources when the acceleration voltage Va for each of the ion sources is set to a constant value. The procedure is described below.

(1) Each of the ion sources is brought in an operating state.
(2) All the ion acceleration voltages Va to the first, the second, the third . . . ion sources are set to the grounding potential.
(3) The voltage Vd applied to the electrostatic deflector is set to the grounding potential.
(4) At a time point t1, the acceleration voltage Va1 for the first ion source is applied.

(5) From time t11, the voltage Vd applied to the electrostatic deflector is swept. Therein, it is sufficient to sweep over the range Vd±10% not from zero if there is data on the value Vd at the precedent measurement, which can save time. An amount of total ions or an ion current value of a specified ion is measured using the mass spectrometer 82 while sweeping.

(6) A point at which the ion current value becomes maximum is the optimum value of the voltage Vd1 applied to the electrostatic deflector. That is, a point in which the ions passed through the small through hole 73 becomes maximum can be obtained. The voltage Vd1 applied to the electrostatic deflector at that time is stored in the data processor 84.

(7) Similarly, the values Vd2, Vd3, . . . for the second, the third, . . . ion sources are obtained. By doing so, the optimum voltages Vd applied to the electrostatic deflector for the ion sources are determined, and selection of the ion source can be performed by the data processor 84.

Figure 13:
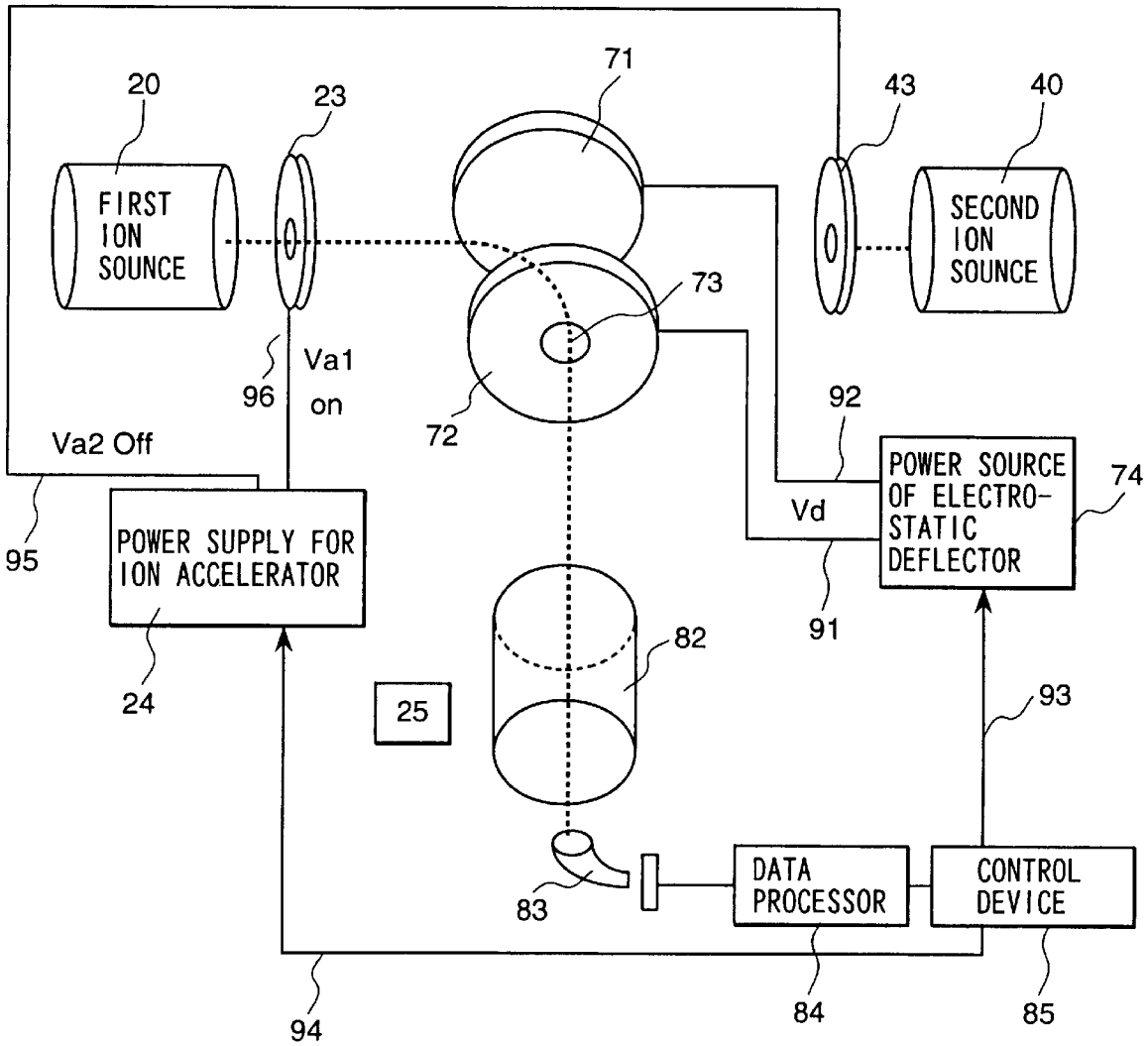
FIG. 13 is a view explaining operation of the first embodiment.

FIG. 13 shows the operation procedure of switching the ion source. Here, description will be made below on an example of two ion sources.

At a time point, the first ion source 20 is selected. Initially, the operator instructs the data processor to select the first ion source 20. The data processor 84 transmits the stored ion acceleration voltage Va1, the stored voltage Vd1 applied to the electrostatic deflector and the switching instruction to the controller 85. The controller 85 transmits a set signal for Va1 a Va2 reset signal to the ion acceleration power supply 24 through a signal line 94. By doing so, the ion acceleration power supply 24 performs setting of Va1 and resetting of Va2 through power supply lines 95, 96. The voltage Vd1 applied to the electrostatic deflector 70 is transmitted to the electrostatic deflector power supply 74 from the controller 85 through a signal line 93 to set the electrodes 71, 72 through power supply lines 91, 92. As a result, only the ions produced in the first ion source 20 are accelerated and deflected to be mass analyzed. That is, the first ion source 20 is selected. After completion of selecting the ion source, an analysis is performed according to the procedure of the normal mass analysis, and data collection is performed by the data processor 84.

Further, selection of the second ion source 40 is similarly performed. That is, the voltage Va2 is turned on, and the Va1 is turned off (the grounding potential).

(Second Embodiment)

Figure 14:
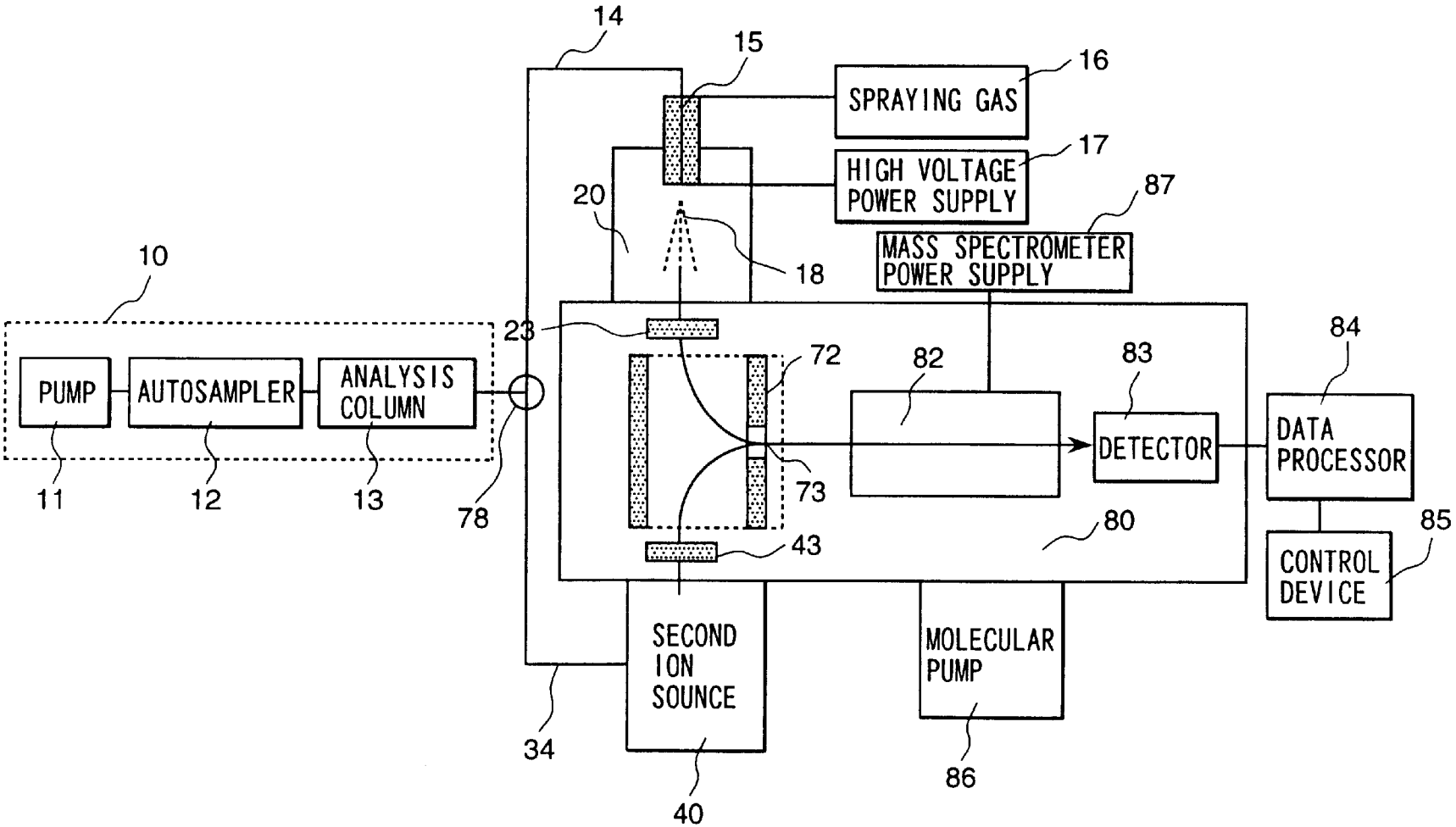
FIG. 14 is a block diagram showing the configuration of a second embodiment.

FIG. 14 shows a second embodiment in accordance with the present invention.

In the first embodiment, the plurality of ion sources are provided with individual liquid chromatographs. In this case, the ion source including the LC can be switched together.

On the other hand, in the present embodiment, a sample component eluted from one LC is diverted by a branching tee 78 to be transferred to two ion sources. Further, in the present embodiment, an ESI is employed for the first ion source 20 and an APCI is employed for the second ion source 40, and the ion sources are switched depending on necessity.

In a case where a reversed-phase column is mounted on the LC, ionic and high polar chemical compounds are eluted in an early (small) period of holding time. On the other hand, in a late (large) period of holding time, hydrophobic chemical compounds are eluted. Among the LC/MS ion sources, the ESI can highly sensitively ionize the ionic and the high polar chemical compounds. On the other hand, the APCI can easily ionize the low polar and the medium polar chemical compounds. In taking use of these properties, the analyses are performed by using the ESI during early holding time and by switching to the APCI in late holding time. By doing so, a sample containing components largely different in polarities can be analyzed by once of measurement.

As an application of the present embodiment, measurement may be performed by using the same kind of ion sources (for example, using two ESIS) and largely changing ionization conditions (ESI applied voltage, counter gas temperature, drift voltage and so on).

Further, the S/N ratio can be improved by operating the two ion sources at a time to increase an amount of ions introducing the mass spectrometer 82.

Furthermore, in a construction of mounting three ion sources, by employing an ESI for first ion source 20, an APCI for the second ion source 40 and an SSI for the third ion source, exchanging of the three ion sources can be easily performed by instantaneously switching the ion acceleration voltage Va.

(Third Embodiment)

Figure 15:
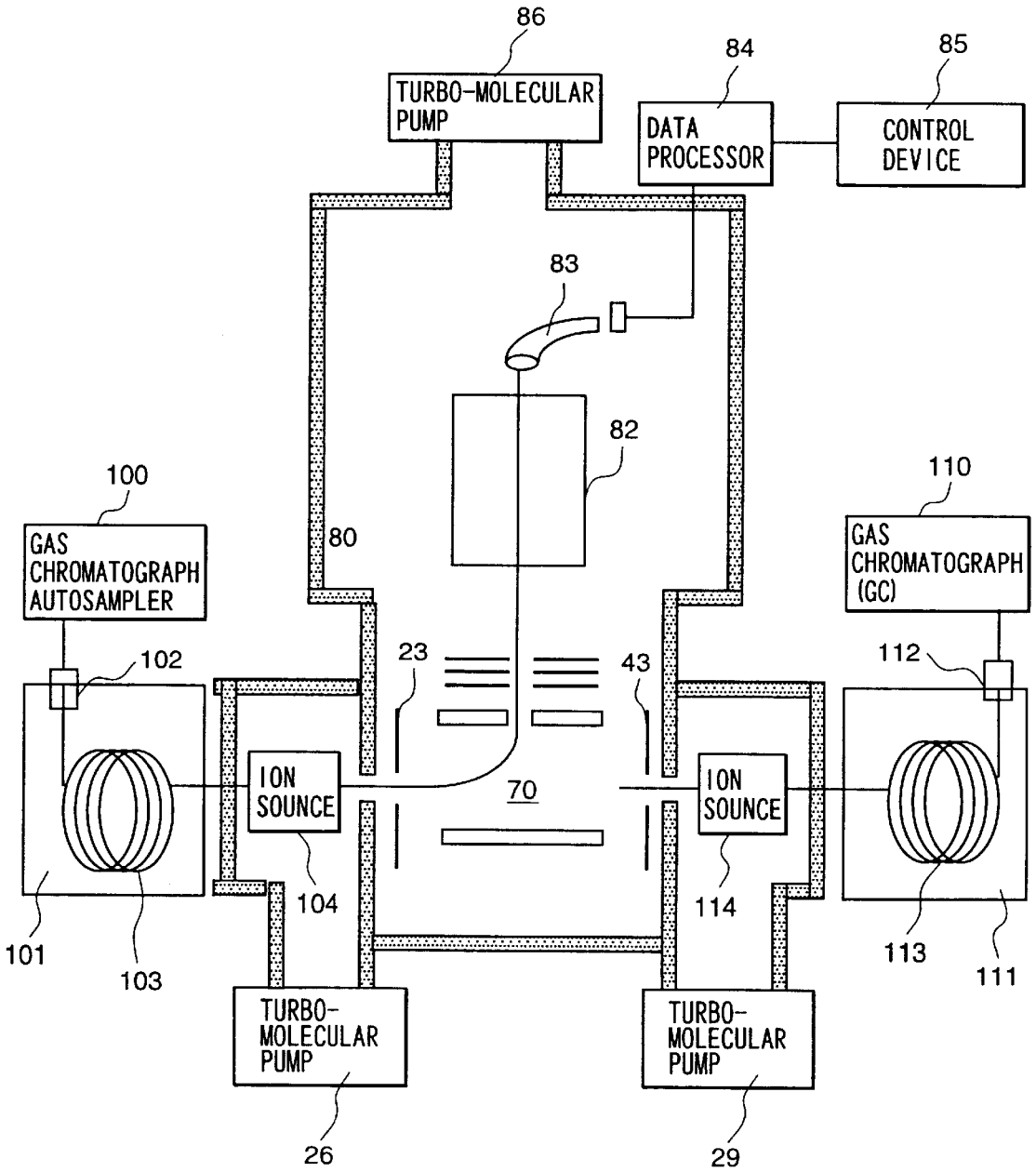
FIG. 15 is a block diagram showing the configuration of a third embodiment.

FIG. 15 is a schematic view showing a third embodiment. The construction of FIG. 15 is a so-called GC/MS in which gas chromatographs (hereinafter, referred to as GC) are connected to an MS, and an example in which two sets of GCs are connected to the MS.

A sample solution sampled by an auto-sampler 100 is injected through an injection port 102 of the GC 101. The sample solution is heated and evaporated there to be introduced into a GC column 103. The sample separated into components through the GC column 103 is introduced into an ion source 104 disposed in a vacuum chamber evacuated by a turbo molecular pump 26. As the ion source 104, an electron ionization (EI) ion source, a chemical ionization (CI) ion source, or an ion source of the other type may be employed as far as ion sources used in a general MS. In a case of the EI, the sample molecules are ionized by receiving impact of thermal electrons emitted from a filament (not shown in the figure). In a case of CI, ions are produced by ion-molecule reaction. The produced ions are emitted from the ion source, and are incident to the electrostatic deflector 70.

Therein, in a case of performing analysis of the GC 101, the incident ions from the ion source 104 are deflected and introduced into the mass spectrometer 82 placed inside the high vacuum chamber 80 evacuated by the turbo molecular pump 86 to be mass analyzed. The sample molecules introduced through the other GC 111 are ionized by the ion source 114.

The ion sources 104 and 114 are arranged radially at positions with respect to the small through hole 73 of the electrostatic deflector 70 as the center. The mass spectrometer 82 is arranged at a position perpendicular to the axis. In the case of GC/MS, the ion source is disposed in an independent vacuum chamber evacuated by a turbo molecular pump 26, which is different from in the case of the LC/MS.

As shown by the present embodiment, in the GC/MS similarly in the LC/MS shown in the above-mentioned embodiment, switching of the ion source can be instantaneously performed only by controlling the voltages applied to the ion sources 23, 43.

(Fourth Embodiment)

Figure 16:
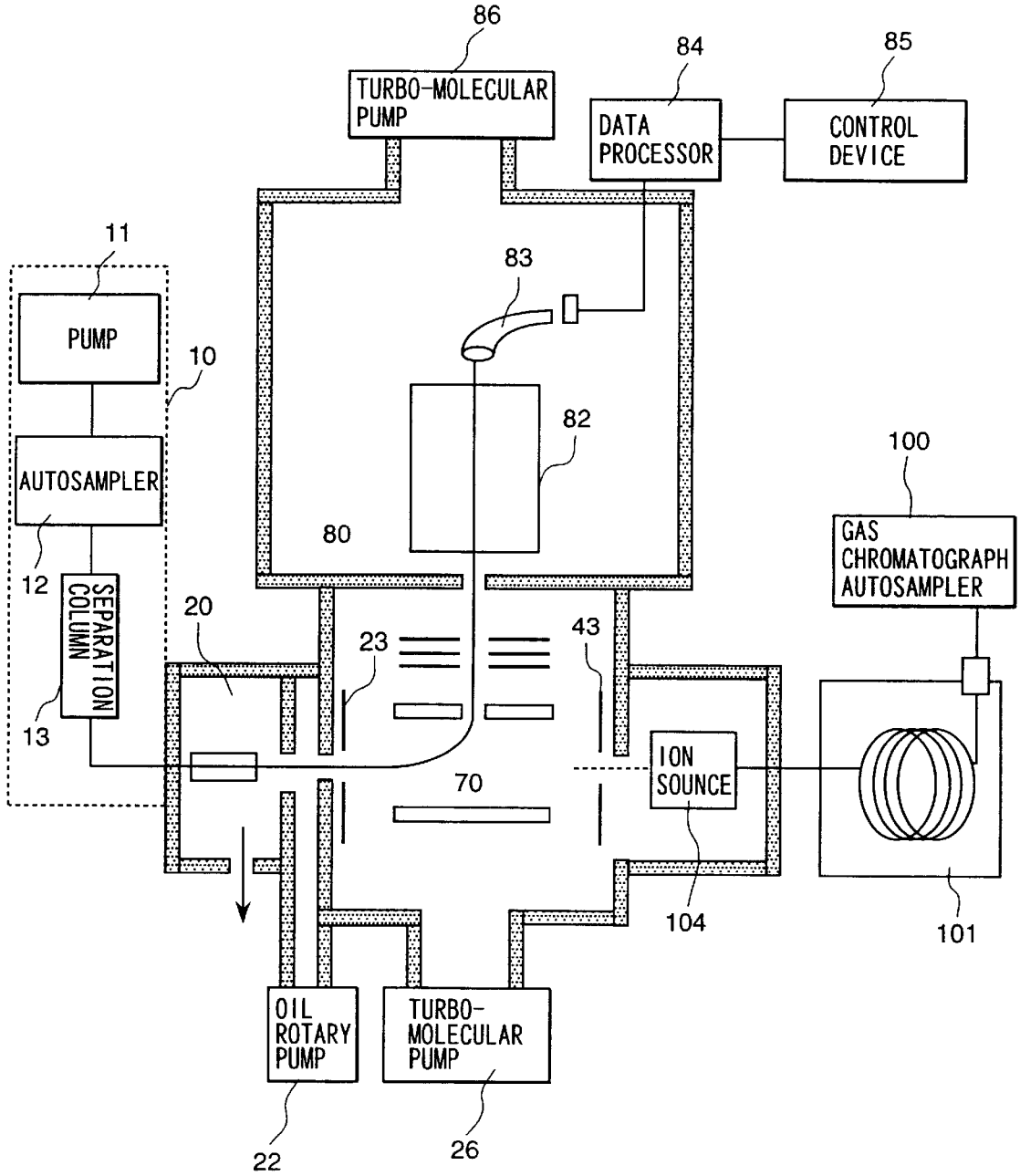
FIG. 16 is a block diagram showing the configuration of a fourth embodiment.

FIG. 16 is a view showing a fourth embodiment. The construction of FIG. 16 is a example in which both of an LC and a GC are connected to an MS.

Components eluted from the LC 10 are ionized by the ion source 20 under atmospheric pressure, and introduced into the vacuum chamber evacuated by the turbo molecular pump 26 through the intermediate pressure chamber evacuated by the oil rotary pump 22. The ions are accelerated by the ion acceleration voltage Va1 applied to the ion acceleration electrode 23, and then are incident to the electrostatic deflector 70 to be deflected. The ions are further introduced into the vacuum chamber 80 evacuated by the turbo molecular pump 86 through the small through hole 73, and mass analyzed by the mass spectrometer 82.

The ion source for the CG 101 is arranged in the side opposite to the atmospheric pressure ion source 20 for the LC and the electrostatic deflector 70. Different from the atmospheric pressure ion source 20, the ion source 104 for the GC/MS si placed inside the same chamber, as the electrostatic deflector 70 is placed, evacuated by the turbo molecular pump 26. The reason is that the ion source 104 for the GC is the electron ionization (EI) ion source which requires a vacuum as low as approximately $10^{-1}$ Pa.

As shown by the present embodiment, the present invention can connect an LC and a GC to one MS, and switching of the ion source can be instantaneously performed only by controlling the voltages applied to the ion acceleration electrodes 23, 43. Further, both of the LC/MS measurement and the GC/MS measurement can be performed.

(Fifth Embodiment)

Figure 17:
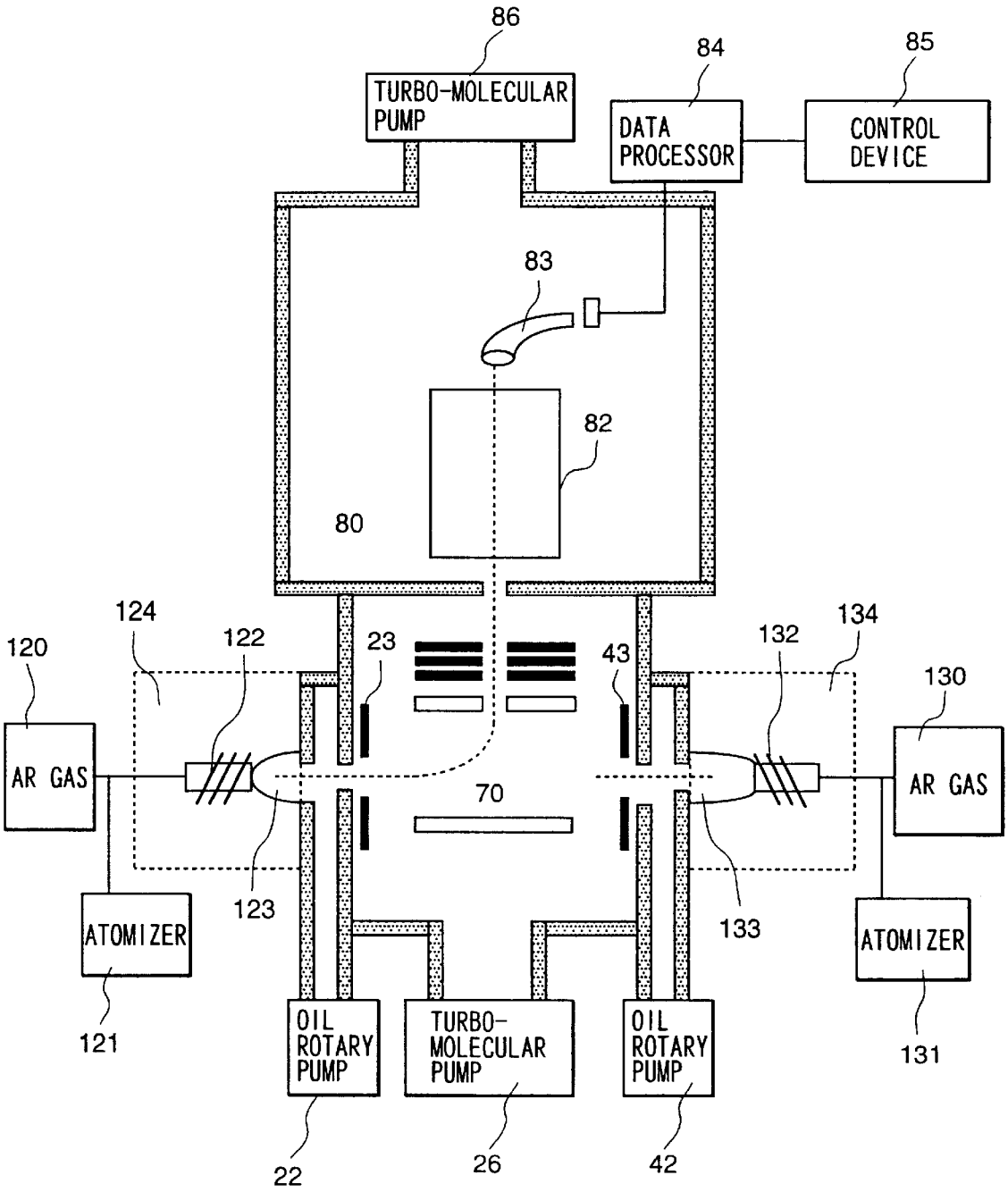
FIG. 17 is a block diagram showing the configuration of a fifth embodiment.

FIG. 17 shows an example of a mass analysis apparatus in which two plasma ion sources (induction coupling plasma (ICP) or microwave induction plasma (MIP)) used for qualitative and quantitative analysis of elements are connected to a MS.

Samples from sample atomizers 121, 131 are mixed with argon gas supplied from argon gas cylinders 120, 130, and supplied to plasma ion sources 124, 134. The argon is formed into plasmas 123, 133 by high frequency induction supplied to the induction coils 122, 132. Metallic elements in the argon are ionized in the high temperature plasma. The produced ions are conducted to the vacuum chamber evacuated by the turbo molecular pump 26 through the intermediate pressure chambers evacuated by oil rotary pumps 22, 42. The ions introduced into the vacuum chamber are accelerated by ion acceleration voltage applied to the ion acceleration electrodes 23, 43, and then deflected by the electrostatic deflector 70.

In the present embodiment, the ions from the two plasma ion sources can be selectively introduced into the mass spectrometer 82 by switching the voltage applied to the ion acceleration electrodes 23, 43, as described in the above mentioned embodiment.

In the present embodiment, the two plasma ion sources 124, 134 are arranged at positions on an identical axis with respect to the electrostatic deflector 70 and perpendicular to the axis of the mass spectrometer 82. By the arrangement described above, light and neutral fine particles emitted from the plasma ion source can not enter into the mass spectrometer 82, and consequently it is possible to construct the ICP-MS which is of low noise and capable of instantaneously switching the two plasma ion sources.

Further, as the two plasma ion sources, two ICPs may be arranged, or one ICP and one MIP may be also arranged.

(Sixth Embodimet)

In the first to the fifth embodiments, it has been shown that an ion source can be freely selected depending on the combination of the ion acceleration voltage Va and the electric field of the electrostatic deflector by arranging the plurality of ion sources around the electrostatic deflector 70. As the sixth embodiment, description will be made on detailed timing of switching the plurality of ion sources.

The switching timing of ion sources in the present invention corresponds to the switching timing of the voltage applied to the ion acceleration electrodes 23, 43. In the present invention, switching of the voltage applied to the ion acceleration electrodes 23, 43 is performed in synchrnism with the mass sweep period of the mass spectrometer 82. Selection of the ion source is performed by supplying the ion acceleration voltage Va to the ion acceleration electrode of the ion source to be selected from the ion acceleration power supply 24 by control from the data processor 84 and the controller 85. By doing so, parallel measurements of the plurality of ion sources can be performed.

Figure 18:
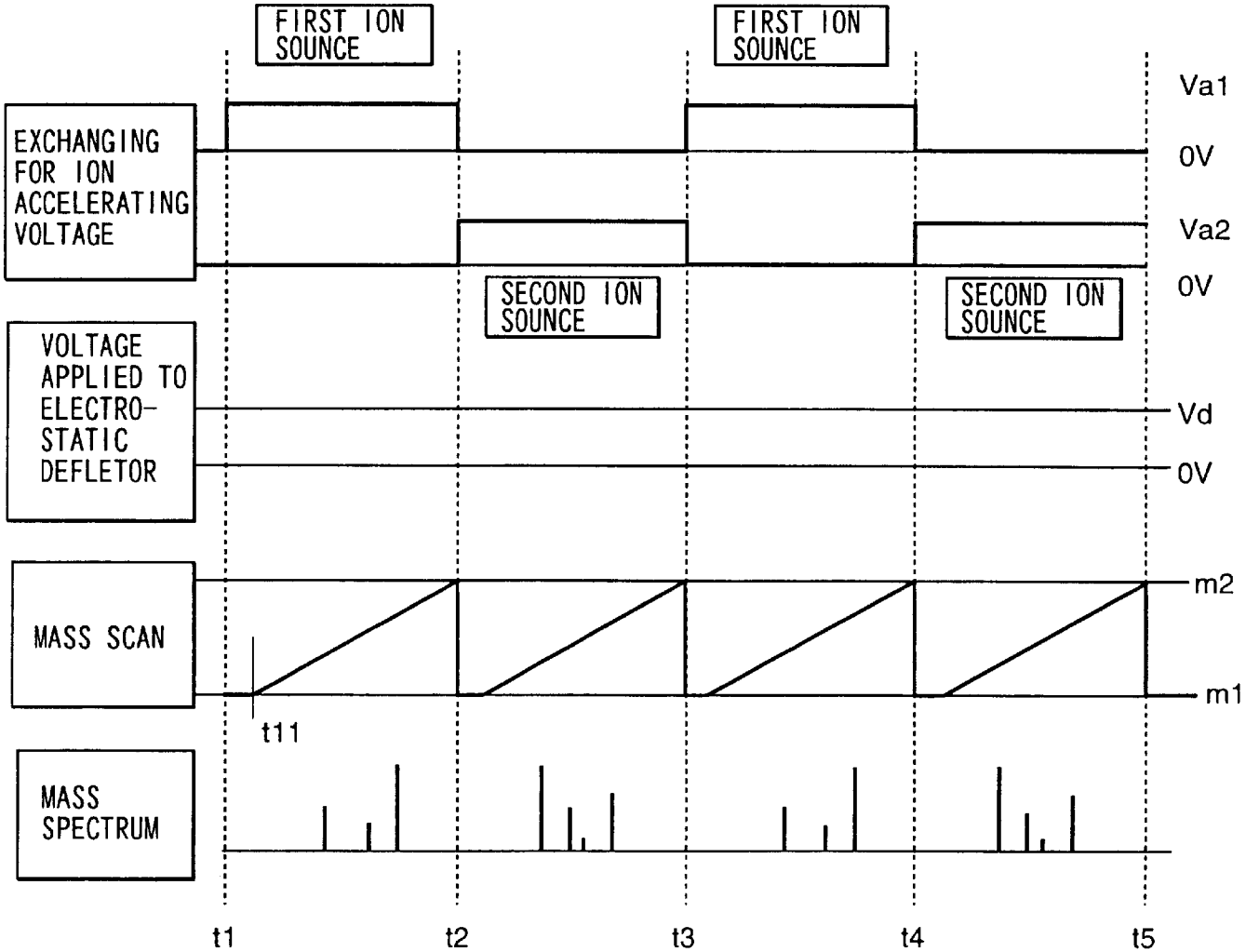
FIG. 18 is a chart showing the measurement operation of a sixth embodiment.

FIG. 18 is a chart showing the timing of switching the ion source by switching of the ion acceleration voltage Va and the timing of mass sweep period of the mass spectrometer 82 in a case of two ion sources. The abscissa of the chart indicates elapsing time.

According to FIG. 18, the first ion source is selected in the period between time points t1 to t2. At t1, the controller 85 instructs the ion acceleration power supply 24 to switch the ion source. The ion acceleration power supply 24 turns on the ion acceleration voltage Va1 of the first ion source 20 and turns off the acceleration voltages of the other ion sources. The voltage Vd applied to the electrostatic deflector 70 is kept to be applied. By doing so, the first ion source is selected.

After a short waiting time, at a time point t11, mass sweep from mass number of m1 to m2 of the mass spectrometer 82 is started. As the mass sweep is started, the data processor 84 measures ion current values together with mass numbers to acquire a mass spectrum. That is, the mass spectrum obtained by the mass sweep is the mass spectrum of the ions produced in the first ion source.

As the mass sweep is completed at a time point t2, the data processor 84 and the controller 85 instruct the ion acceleration power supply 24 to switch the ion acceleration voltage. By doing so, the second ion source is selected. Further, similarly, after a waiting time, mass sweep is started, and the data processor 84 collects a mass spectrum from the second ion source. By repeating this processing, mass spectrums for the first ion source are recorded in the odd-numbered mass sweeps, and mass spectrums for the second ion source are recorded in the even-numbered mass sweeps to complete a mass spectrum file on the memory unit of the data processor 84. That is, a collection of data as the "mass spectrum" shown in the lowermost portion of FIG. 18 is formed.

Figure 19:
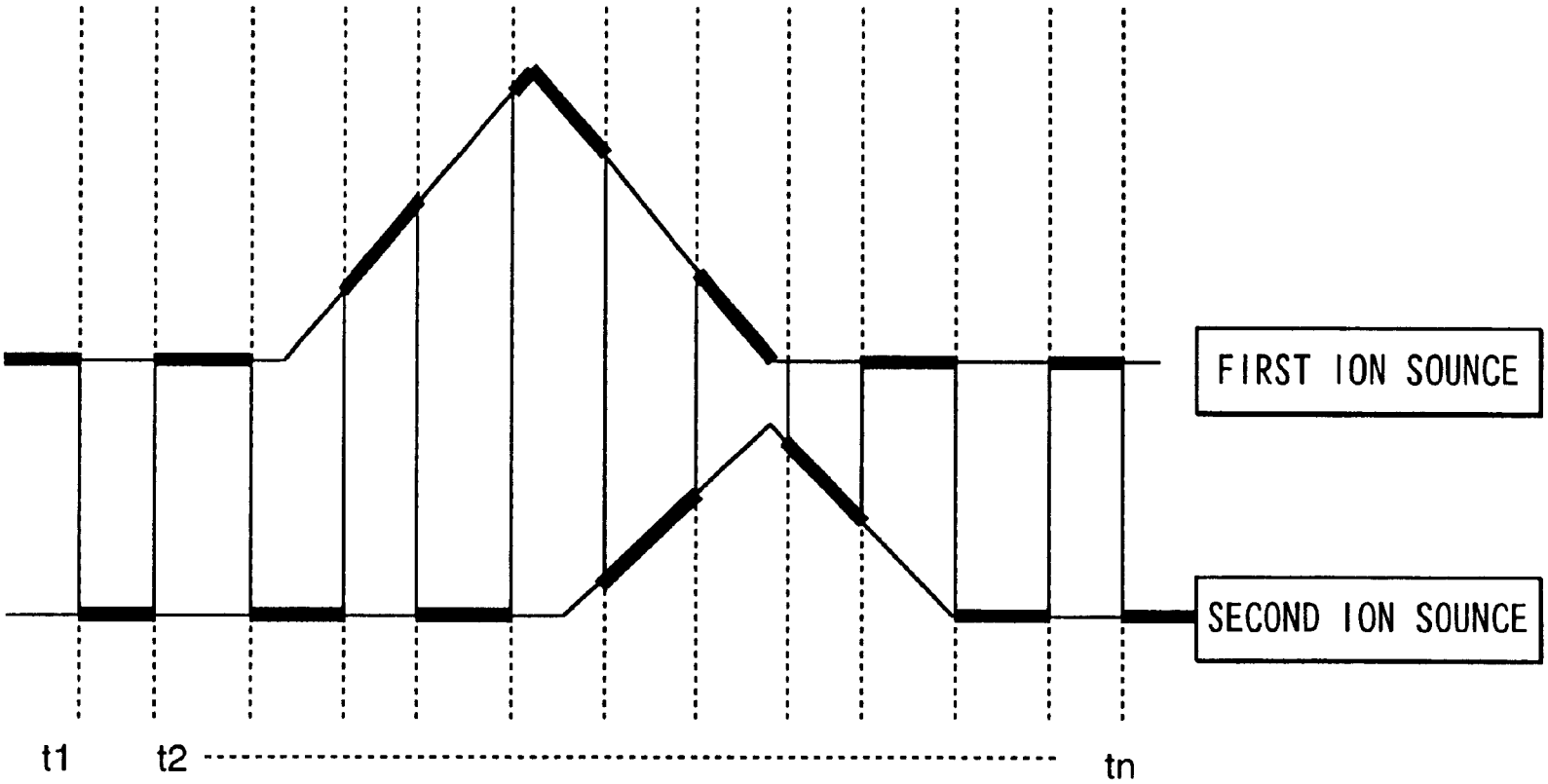
FIG. 19 is a chart showing chromatogram when two ion sources are measured.
Figure 20:
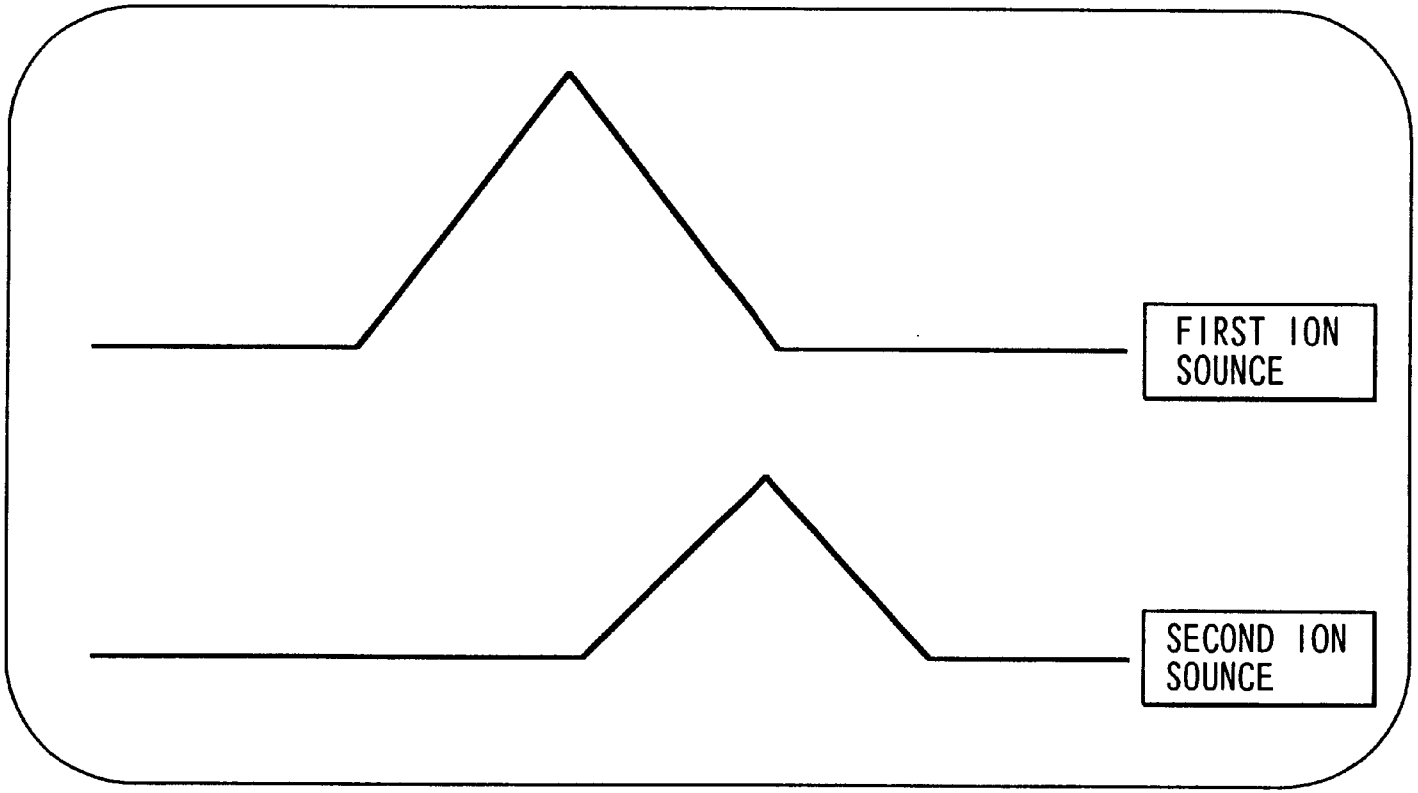
FIG. 20 is a chart showing an example of an output from a CRT or a printer.

FIG. 19 shows a chromatogram from the two ion sources collected by the timings of FIG. 18. Therein, the ordinate indicates ion current value and the abscissa indicates time. The upper portion of FIG. 19 is a chromatogram by the first ion source, and the lower portion is a chromatogram by the second ion source. Since the data collection is alternatively performed from the two ion sources in synchronism with the mass sweep, the data is collected in the form shown by the thick lines in the data processor 84. That is, data collection is alternatively performed on the ions from the two ion sources in the time sharing (t1, t2, . . . , tn). After the data collection, the data processor 84 arranges the data and interpolates values between the data sections to reproduce the original mass chromatogram as shown in FIG. 20 and to output the result to a CRT or a printer.

The mass sweep of the mass spectrometer 82 can be performed in 0.1 second to 0.5 second for the range of mass number 20 to mass number 2000. In the case of FIG. 19, one period for LC measurement is twice of the mass sweep time. That is, data per one component (one LC) can be acquired with an interval of 0.2 second to 1 second.

In the case of the GC, eluting time per one component is as short as several seconds, but data acquisition of 0.2 second interval can sufficiently follow the change in chromatogram and can perform a quantitative analysis.

In the case of the LC, since eluting time of component is several tens seconds, measurement of one second period can sufficiently follow the change in chromatogram.

In regard to the mass sweep, the so-called SIM (selected ion monitoring) method performing step-shaped sweep, not linear sweep, is widely used due to highly sensitive measurement. In this case, it is sufficient that the period of switching the ion source is made to agree with the period of the step sweep period, similarly to the case of FIG. 18. Further, it is also possible that the period of switching the ion source is made to differ from the period of the step sweep period.

Figure 21:
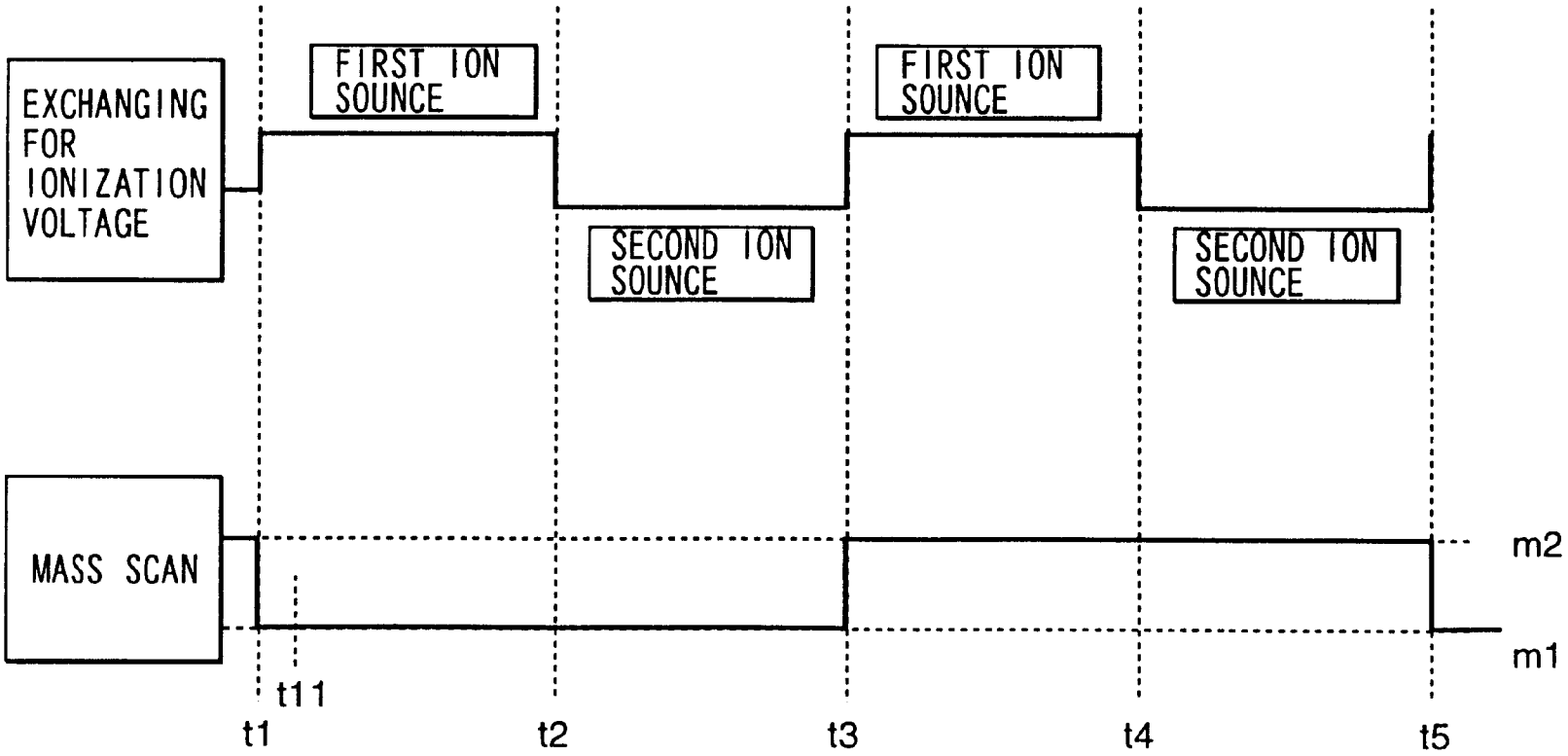
FIG. 21 is a chart showing other measurement operation of the sixth embodiment.
Figure 22:
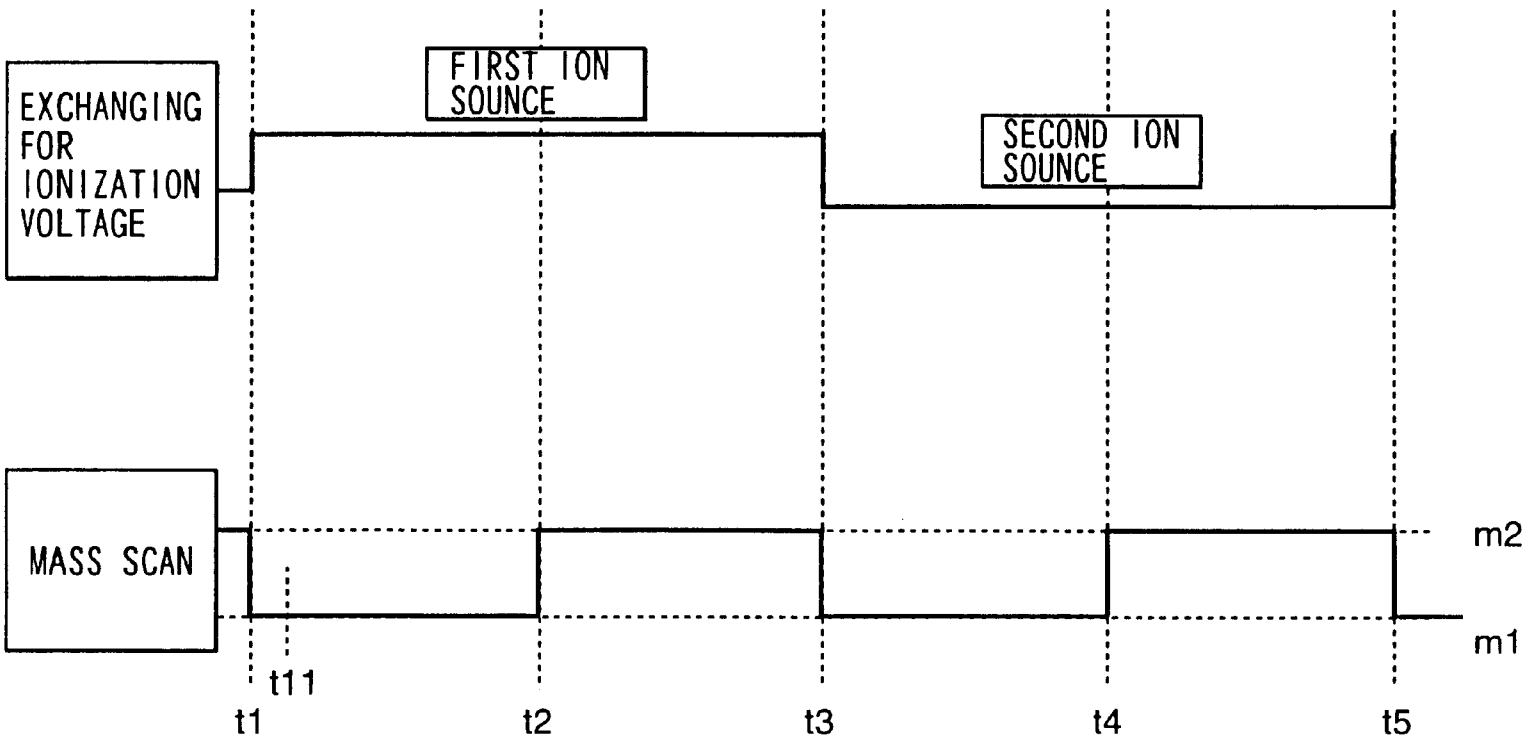
FIG. 22 is a chart showing other measurement operation of the sixth embodiment.

FIG. 21 and FIG. 22 show examples of the SIM method in the case where the period of switching the ion source is made to differ from the period of the step sweep period.

In FIG. 21, switching of the ion source is performed at a high speed during one step of the step sweep of the mass spectrometer 82 (detection of ions for one mass number). In a case of using n units of ion sources, the period of switching the ion source becomes a value of multiplying 1/n to the time of one step of mass number sweep.

That is, although the mass spectrometer 82 detects ions having a mass number m1 during the period from the time point t1 to the time point t3, switching from the first ion source to the second ion source is performed at the time point t2 between t1 and t3. Further, in the next period, the mass spectrometer 82 detects ions having a mass number m2 during the period from the time point t3 to the time point t5. Switching of the ion source is also performed at the time point t4 between t3 and t5. By doing so, in the memory of the data processor 84, data coming from the first ion source is filed during the odd-numbered period, and data coming from the second ion source is filed during the even-numbered period. Furthermore, acquired data on quantities of ions for each mass number is recorded in order of m1, m2, . . . . The data processor 82 processes the data to output chromatograms to the CRT or the printer.

Another method is shown in FIG. 22. In the example of FIG. 22, switching of the ion source is performed every mass number step, but a plurality of mass number steps are swept during selecting one ion source.

In a case where ions having m different mass numbers are measured, letting measuring time per one mass number be td, the time of switching the ion source becomes the product of the both, that is, m·td. Since the relationship between the switching of the ion source and data is controlled by the data processor 84 in the cases of FIG. 21 and FIG. 22, the acquired data can be post-processed to be output an independent chromatogram to the CRT or the like.

By performing operation of switching the ion source in the manner as described in the present embodiment, parallel measurements of a plurality of ion sources can be performed using one MS.

(Seventh Embodiment)

In the above-mentioned embodiments, it has been described that ions are directly introduced into the electrostatic deflector 70 from the ion acceleration electrode 23, but an electrostatic lens, a high frequency multipole (quadrupole, hexapole, octopole, . . . ) ion guide or the like may be inserted between the ion acceleration electrode 23 and the electrostatic deflector 70.

Figure 23:
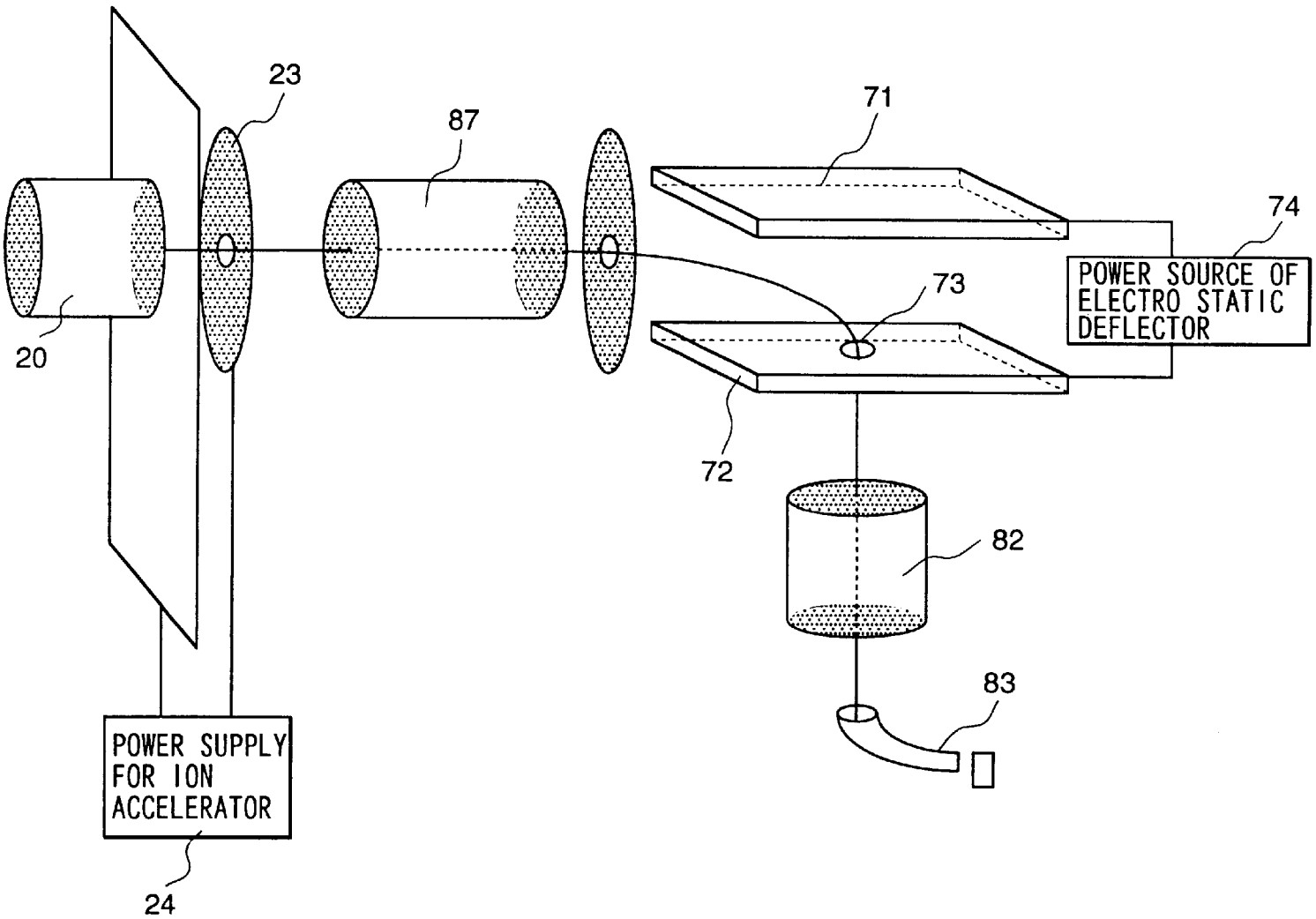
FIG. 23 is a block diagram showing the configuration of a seventh embodiment.

By arranging a high frequency multipole ion guide 87 between the ion acceleration electrode 23 and the electrostatic deflector 70, as shown in FIG. 23, the efficiency of ion transmission can be largely improved. The ions produced in the ion source 20 are accelerated by the ion acceleration voltage Va, as described above. The region where the ions are accelerated is a region where the ions and the atmospheric molecules are introduced from atmosphere into the vacuum chamber. Therefore, pressure in the region is high and can not be in a high vacuum. The accelerated ions collide with the remaining gas molecules to lose their kinetic energy. Since acceleration and kinetic energy loss of the ions occur, deviation occurs in the kinetic energy of ions. This deviation in the kinetic energy spreads the ion beam inside the electrostatic deflector 70, as shown in FIG. 10. Thereby, part of the ions produced in the ion source 20 are lost. In order to recover the loss, the high frequency multipole ion guide 87 is used. The high frequency multipole ion guide 87 can converge the ions toward the central axis of the ion guide, and can average (equalize) the velocity of the ions by collision between the remaining gas molecules and the ions. Therefore, it is possible to prevent the spread of the ion beam caused by deflection of the ions in the electrostatic deflector 70. That is, the ion beam can be deflected and can efficiently pass through the small through hole 73.

In the first to the seventh embodiments described above, selection of the ions is performed only by switching on/off the ion acceleration voltages. However, the ion beam may be blocked by intentionally shifting the combination of the ion acceleration voltage and the voltage applied to the electrostatic deflector, as described in the first embodiment.

Further, the ion beam may be blocked by placing an ion deflector between the ion acceleration electrode and the electrostatic deflector 70, and keeping the ion deflector in the grounding potential during normal state so as to not affect the ion beam, and applying a deflection voltage to the ion deflector in order to block the ion beam when the ion beam is required to be blocked.

Furthermore, the ion beam may be blocked by placing an Einzel lens instead of the ion deflector, and controlling an voltage to the Einzel lens.

(Eighth Embodiment)

In the embodiments described above, the ions are deflected by the electrostatic deflector 70. However, the present invention can be realized by using a quadrupole deflector.

Figure 24:
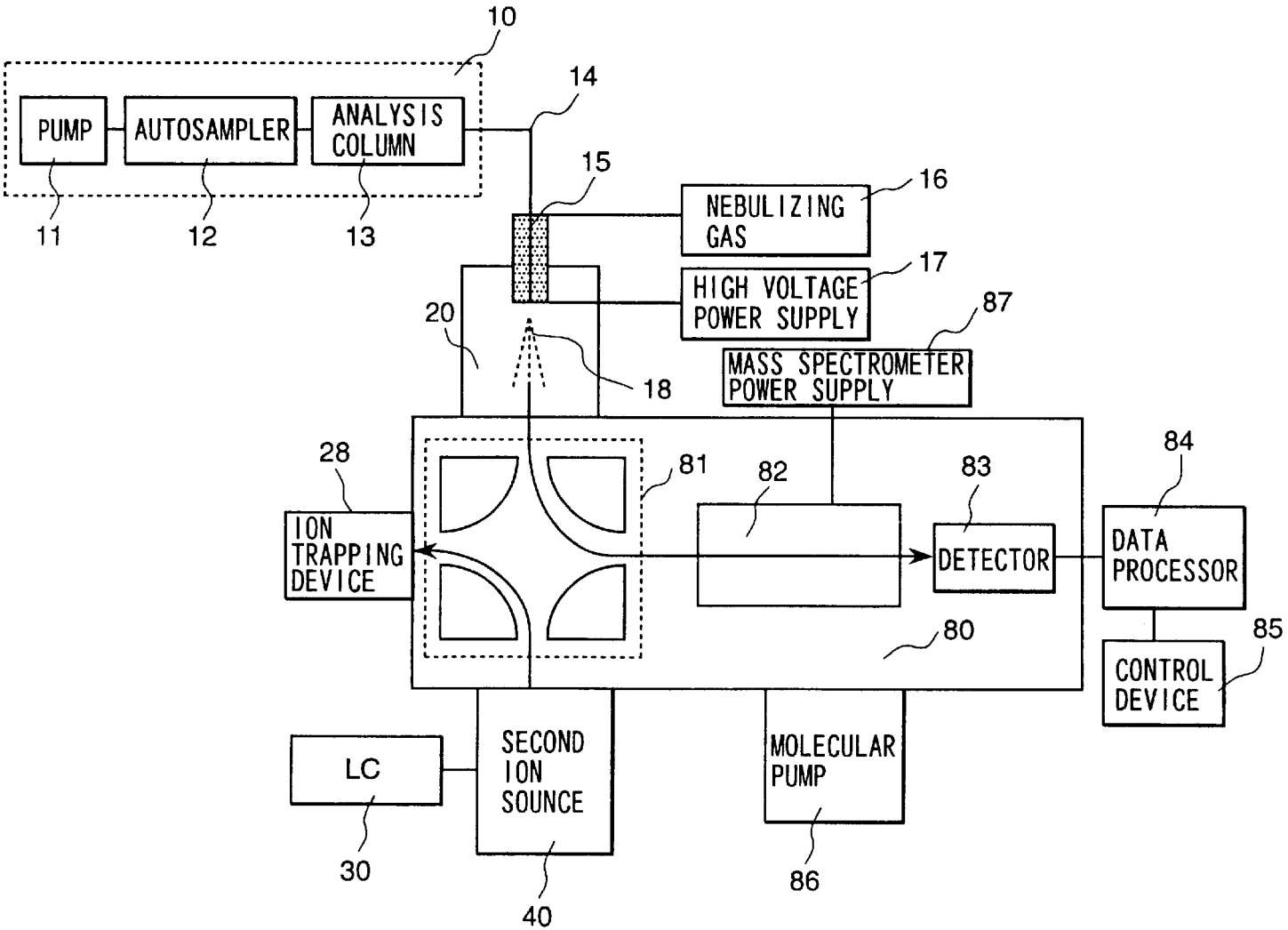
FIG. 24 is a block diagram showing the configuration of an eighth embodiment.

FIG. 24 is a schematic view showing the embodiment of an LC/MS apparatus. The configuration is the same as that of the first embodiment except for using the quadrupole deflector 81 as the ion deflecting means.

The ions produced in the first ion source 20 are introduced into the vacuum chamber 80 evacuated by the vacuum pump 86. The ions are deflected in 90 degrees by the quadrupole deflector 81, and conducted to the mass spectrometer 82 to be analyzed. The ions are detected by the detector 83, and the mass spectrum or the mass chromatogram is calculated in the data processor 84.

Similarly, the ions produced in the second ion source 40 are deflected in 90 degrees by the quadrupole deflector 81, and conducted to the mass spectrometer 82 to be analyzed.

Figure 25:
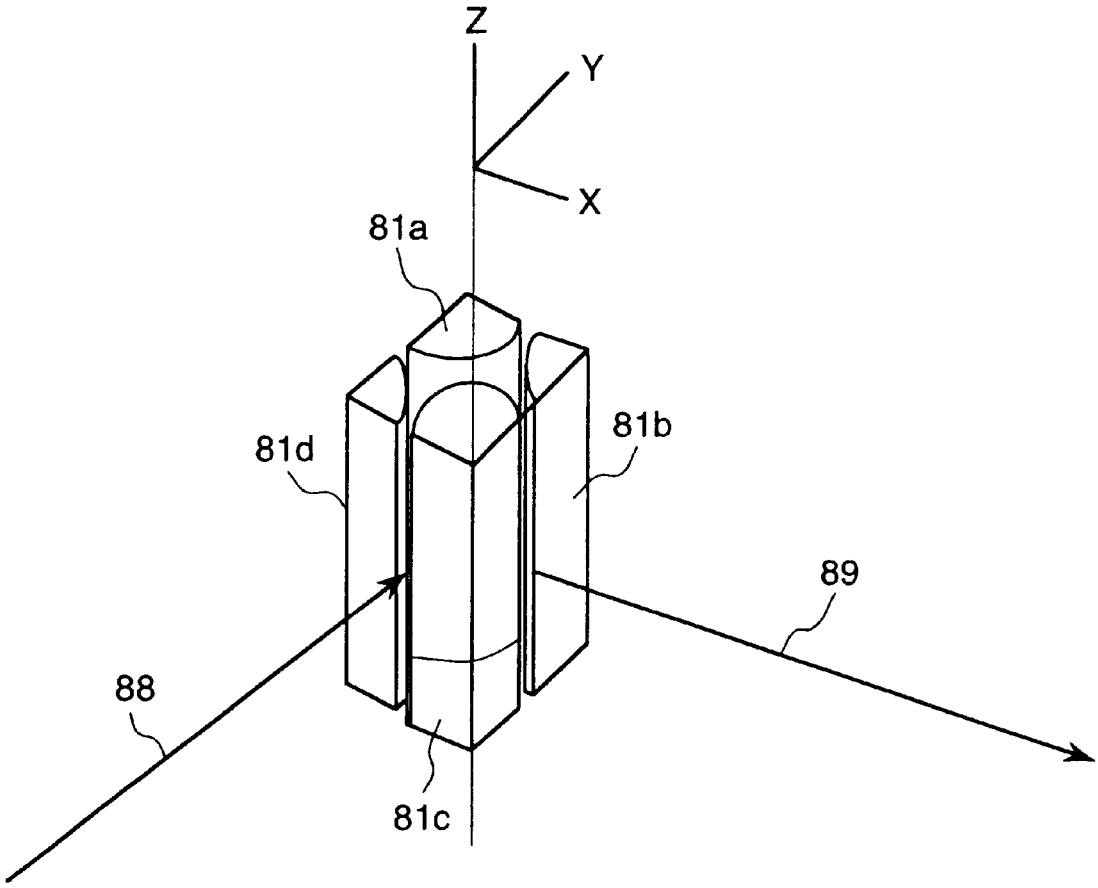
FIG. 25 is a view showing the outer appearance of a quadrupole deflector.

In order to connect the two LC to the one MS in this embodiment, one of the most important components is the above-mentioned quadrupole deflector 81. The atmospheric pressure ion sources of the LC are respectively arranged on the two surfaces opposite to the quadrupole deflector 81, as shown in FIG. 24. The ions incident from each of the surface of the quadrupole deflector 81 are deflected by the quadrupole electric field inside the quadrupole deflector 81, and only the ions from one of the ion sources are selectively introduced into the mass spectrometer. The ions from the other of the ion sources are deflected in the direction opposite to the mass spectrometer 82 to be trapped to an ion trap 28, and can not enter into the mass spectrometer 82. Selection of ions to be introduced is performed by changing a voltage applied to the four electrodes of the quadrupole deflector 81. FIG. 25 is a schematic view of the quadrupole deflector 81 of FIG. 24. The quadrupole deflector 81 is assembled by arranging four electrodes formed by dividing one circular column or one circular cylinder into quarters so that the arc portions face one another. The cut side surfaces of the divided quarters are faced outward to form a quadrangular prism. The four electrodes are assembled inside a quadrangular cylinder (not shown) through insulators. Pairs of electrodes are defined that one pair is formed by the electrodes 81*a* and 81*c* opposite to each other among the four electrodes, and the other pair is formed by the electrodes 81*b* and 81*d* opposite to each other. A direct current voltage is applied between the two pairs of electrodes. The ions are introduced through the gap between the electrodes in the side surface side (the X-Y plane) and not from the longitudinal (the Z direction) of the quadrupole deflector. For example, in a case where a positive ion beam 88 enters through the gap between the electrodes in the side surface side (the X-Y plane), and a negative voltage is applied to the electrodes 81*a*, 81*c*, and a positive voltage is applied to the electrodes 81*b*, 81*d*, the ions are deflected in 90 degrees to go out through the gap between the electrodes 81*b* and 81*c* of the quadrupole deflector 81, that is, to go out to the external along the X-axis direction 89. As described above, the quadrupole deflector 81 can easily deflect the ions in 90 degrees.

Figure 26:
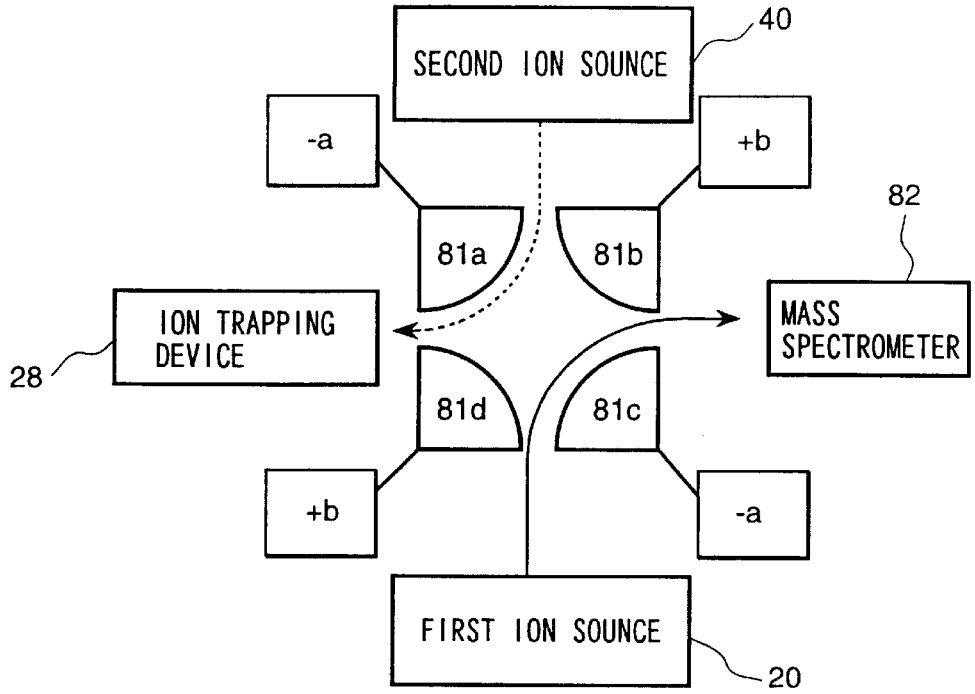
FIG. 26 is a view explaining deflection of ions by the quadrupole deflector.
Figure 27:
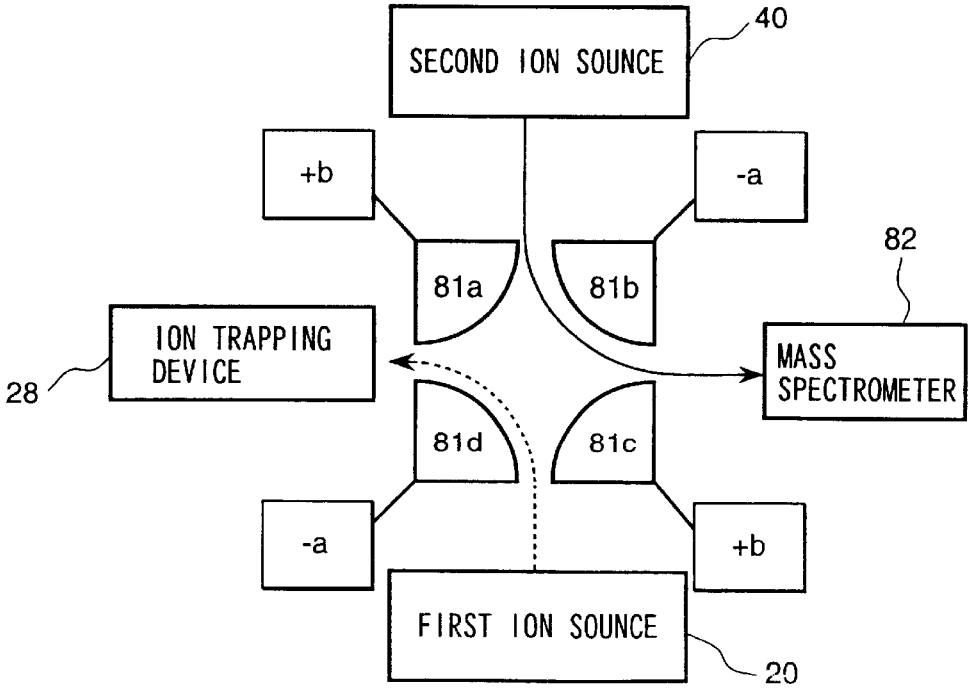
FIG. 27 is a view explaining deflection of ions by the quadrupole deflector.

FIG. 26 and FIG. 27 show the operative function of the quadrupole deflector 81.

FIG. 26 shows a case where the ions produced in the first ion source 20 are introduced into the mass spectrometer 82. The ions produced in each of the ion sources are accelerated by an acceleration voltage "A" V and incident to the quadruple deflector 81. At that time, a direct current voltage of "−a·A" is applied to the electrodes 81*a*, 81*c*. On the other hand, a direct current voltage of "+b·A" is applied to the electrodes 81*b*, 81*d*. As a result, a quadrupole electrostatic field is formed inside the quadrupole deflector 81. Therefore, the ions from the first ion source 20 are deflected in 90 degrees to be conducted to the mass spectrometer 82. At that time, the ions from the second ion source 40 are incident to the quadrupole electrode through the gap between the electrodes 81*a* and 81*b*, and the incident ions are deflected as shown by the dashed line to be trapped by the ion trap 28 and are not incident to the mass spectrometer 82.

The ion trap 28 is a cylindrical metallic container which traps incident ions and also traps secondary ions produced by collision of the incident ions. By providing the ion trap 28, ions and electrons scattering inside the vacuum chamber 27 can be eliminated, and an amount of noise can be reduced, and consequently highly accurate analysis can be performed. Further, by connecting a direct current amplifier (not shown) to the ion trap 28, the ion current may be measured. It is preferable that the ion trap 28 is constructed so as to be detached and cleaned when the ion trap 28 is contaminated due to a long time measurement.

FIG. 27 shows a case where the ions produced in the second ion source 40 are introduced into the mass spectrometer 82. In this case, a voltage of "+b·A" is applied to the electrodes 81*a*, 81*c*. On the other hand, a voltage of "−a·A" is applied to the electrodes 81*b*, 81*d*. That is, this application of the voltage is inverse to that of FIG. 26. As a result, the ions produced in the second atmospheric pressure ion source 40 are deflected in 90 degrees, as shown by the solid line, by the electric field of the quadrupole deflector 81 to be introduced into the mass spectrometer 82. On the other hand, the ions introduced into the quadrupole electrode 81 from the first ion source 20 travel along the path shown by the dashed line, and are not introduced into the mass spectrometer 82.

As described above, it is possible to select one ion source between two ion sources in operation at a time by switching the voltages applied to the four electrodes composing the quadrupole deflector 81. Actually, the voltages applied to the electrodes are approximately (a=) −0.45 V and (b=) +0.6 V. Since the ion acceleration voltage A in the quadrupole mass analyzer is approximately 20 V, the voltages applied to the electrodes of the quadrupole deflector 81 are approximately −9 V and +12 V.

The timing of switching the ion source in the present embodiment can be performed in synchronism with the period of the mass sweep of the mass spectrometer 82, similarly to the above-mentioned embodiments using the electrostatic deflector using the flat plate electrodes. Further, of course, the present embodiment can perform measurement by the SIM method shown in FIG. 21 and FIG. 22.

Furthermore, the quadrupole deflector 81 used in the present embodiment can be similarly applied to the apparatus of combining the CG/MS and the plasma ionization MS shown in FIG. 15 to FIG. 17.

(Ninth Embodiment)

Figure 28:
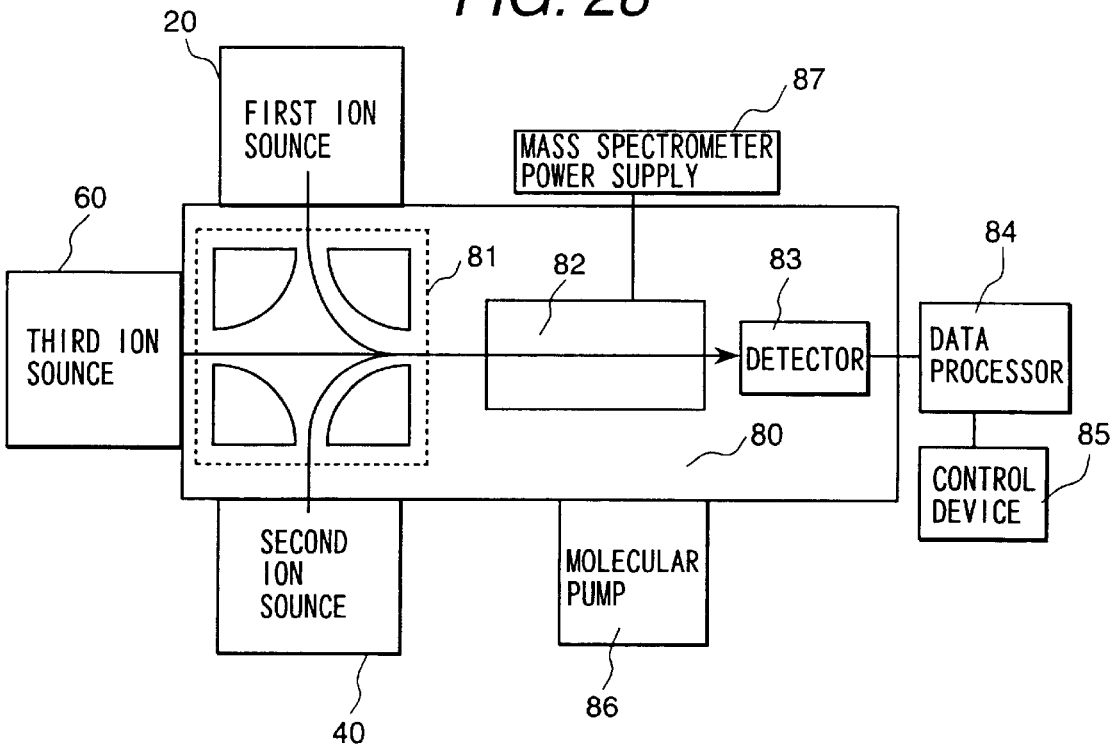
FIG. 28 is a block diagram showing the configuration of a ninth embodiment.

FIG. 28 shows a ninth embodiment. The present embodiment newly comprises a third ion source 60 instead of the ion trap 28 which the eighth embodiment comprises. The point that the quadrupole deflector is used is not changed from the eighth embodiment.

Figure 29:
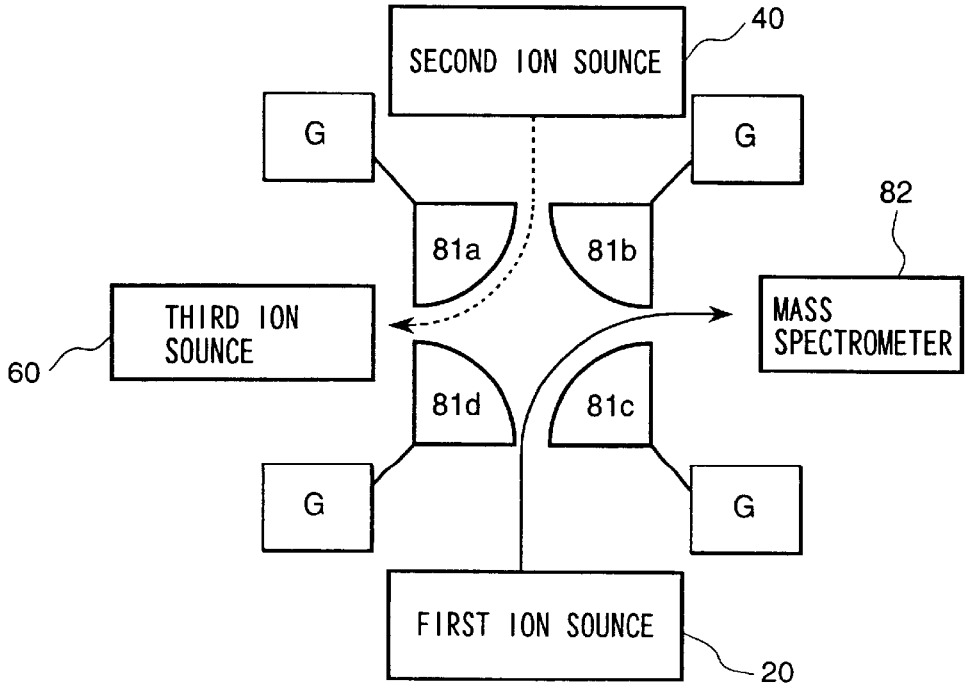
FIG. 29 is a view explaining deflection of ions by the quadrupole deflector.

FIG. 29 shows the method of selectively introducing ions from the third ion source 60 into the mass spectrometer 82. In this case, all the four electrodes 81*a*, 81*b*, 81*c*, 81*d* composing the quadrupole deflector 81 are set to the same voltage (for example, the grounding potential). The ions produced in the third ion source 60 travel straight as shown by the solid line to enter the mass spectrometer 82. Since the ions produced in the first and the second ion sources 20, 40 also travel straight (dashed line), the ions are not introduced into the mass spectrometer 82.

In a case where the ions produced in the first and the second ion sources 20, 40 are introduced into the mass spectrometer 82, control similar to in the eighth embodiment is performed.

Figure 30:
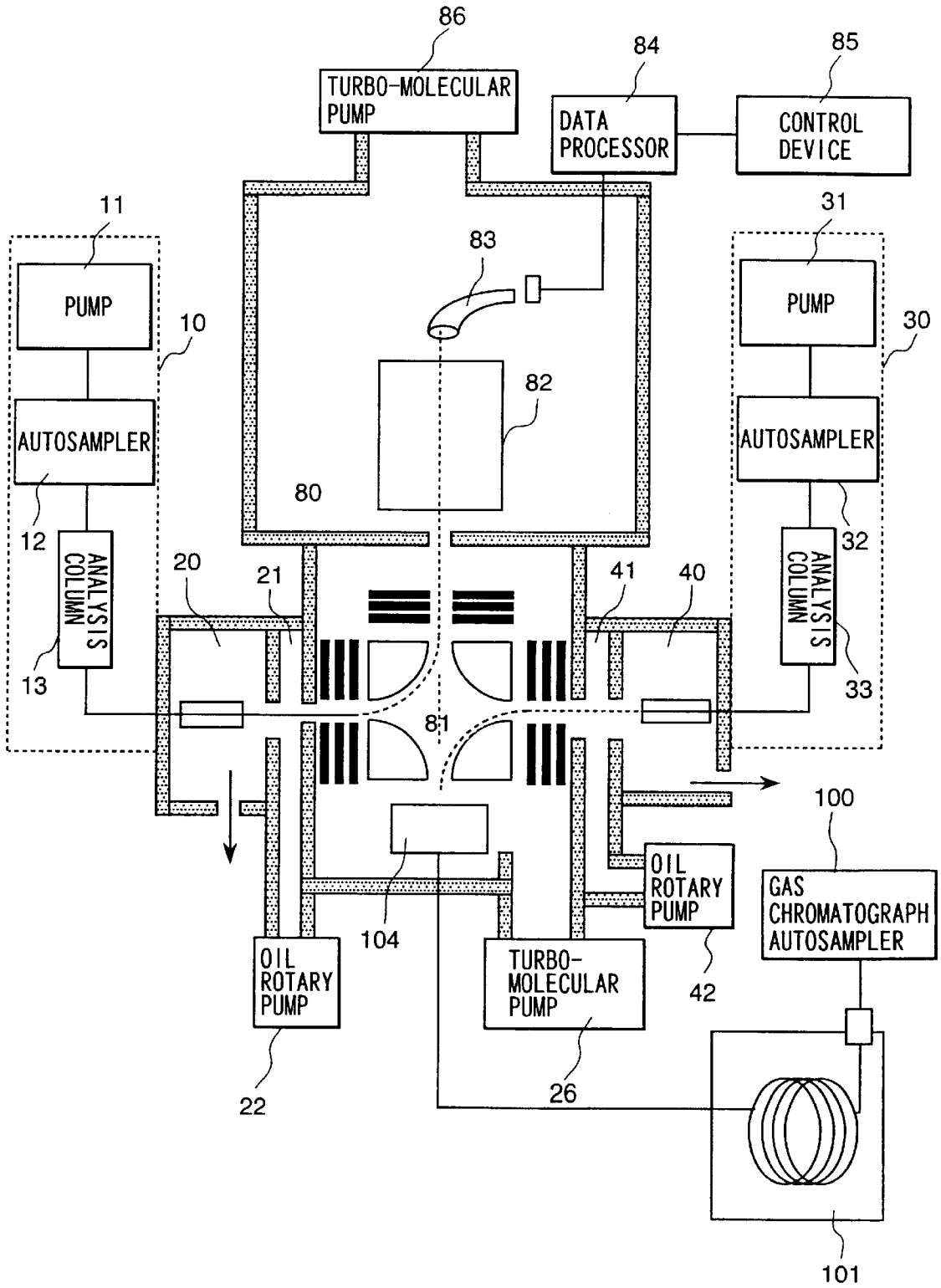
FIG. 30 is a view showing a detailed configuration of the ninth embodiment.
Figure 31:
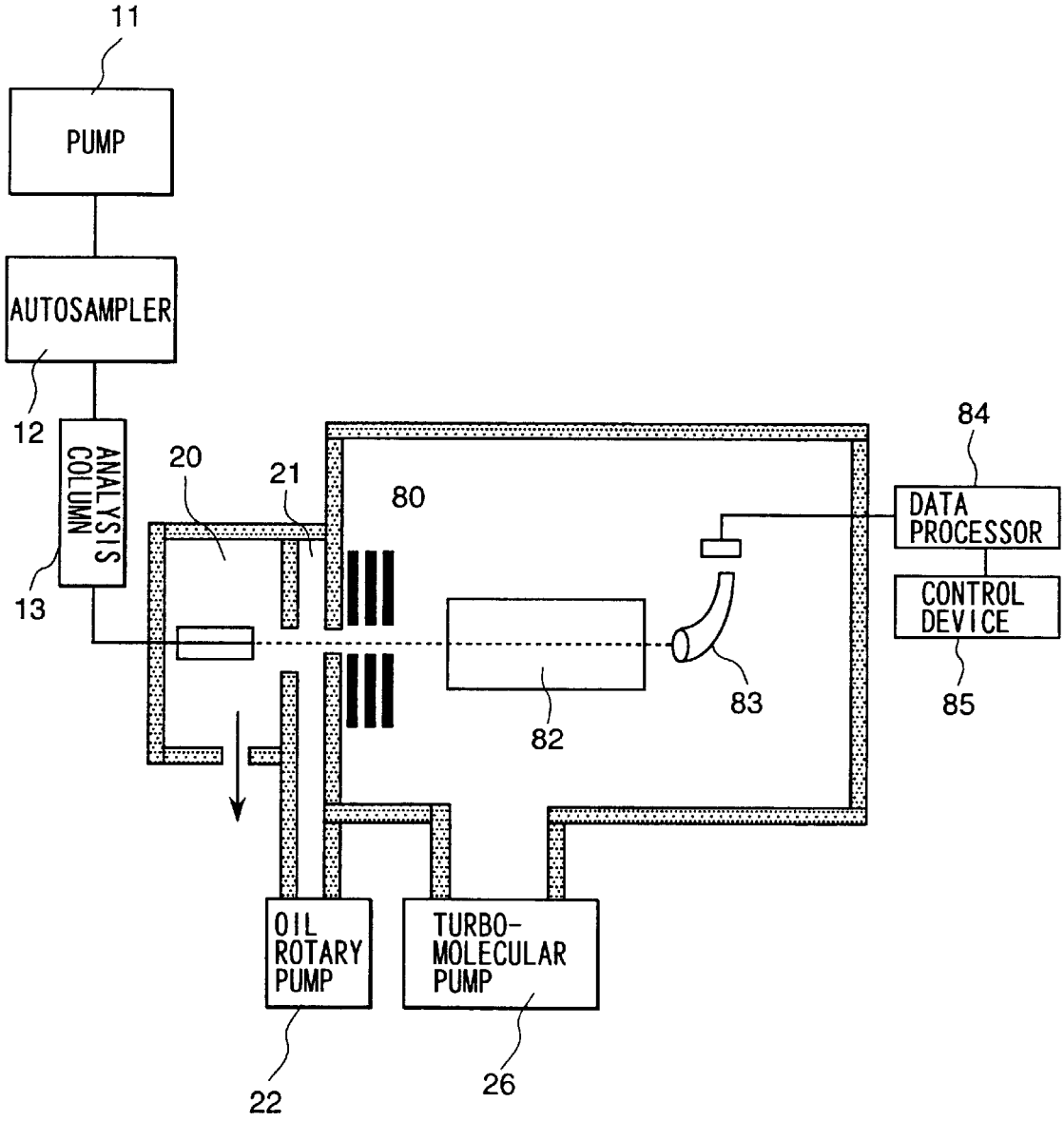
FIG. 31 is a block diagram showing a conventional example.
Figure 32:
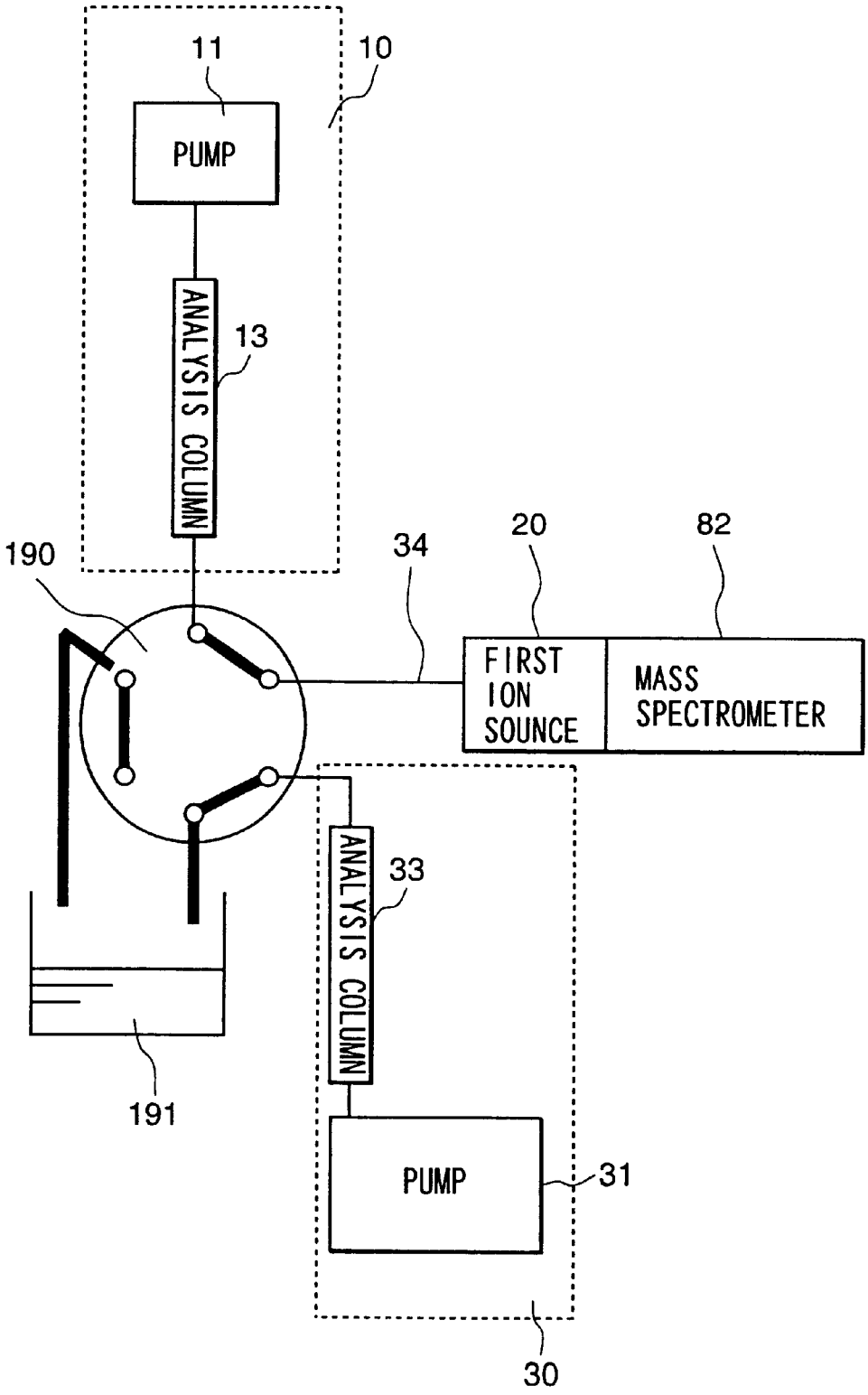
FIG. 32 is a block diagram showing a conventional example.

FIG. 30 shows a further detailed example of the present embodiment. This is an example in which two atmospheric pressure ion sources 20, 40 for LC and one EI ion source 104 for GC are arranged to one MS.

The present embodiment can instantaneously select an ionized sample from ionized samples from the first LC 10, the second LC and the GC 101 by switching voltages applied to the quadrupole deflector 81 to introduce the selected ionized sample into the mass spectrometer 82.

In the example of FIG. 30, the GC ion source 104 is arranged on the same axis as the mass spectrometer 82. On the other hand, the LC atmospheric pressure ion sources 20, 40 are arranged perpendicularly to the axis of the mass spectrometer 82. The reason is that there are advantages as described below. The ion sources 20, 40 of the LC/MS emit liquid droplets and neutral fine particles in addition to ions because the ion sources 20, 40 are atmospheric pressure ion sources. The neutral fine particles and so on are detected as noise when they are introduced into the mass spectrometer 82. Further, even if the neutral fine particles and so on enter into the quadrupole deflector 81, the neutral fine particles and so on travel straight and enter into the detector to cause noise because they are not deflected by the quadrupole deflector 81. Therefore, the arrangement as shown in FIG. 30 can prevent the neutral fine particles and so on emitted from the ion sources 20, 40 from entering into the mass spectrometer 82. By doing so, the noise on a mass spectrum can be reduced.

On the other hand, the EI of the GC/MS or the CI ion source 104 does not produce any neutral fine particles and so on because it ionizes gas in the vacuum, which is different from the atmospheric pressure ion source of the LC/MS. Therefore, there is no problem even if the EI of the GC/MS or the CI ion source 104 is arranged at a position where the neutral fine particles travel straight through the quadrupole deflector 81 and can not be removed.

The configuration of the present embodiment has a disadvantage in that the accuracy of measurement is lower than that of the configurations of the aforementioned embodiments due to the effect of ions not conducted to the mass spectrometer 82. However, the present embodiment has an advantage that measurement of higher throughput can be performed by additionally providing the ion source.

Furthermore, by the configuration as shown in FIG. 30, the GC/MS and The LC/MS are realized at a time, and accordingly the efficiency of analysis requiring the both methods can be largely increased.

The LC ion source 20 or 40 may be replaced by a plasma ion source. By the configuration, measurement using the plasma ionization MS becomes possible in addition to the measurement using the GC/MS and the LC/MS.

In the present embodiment, the three ion sources can be switched and used by arranging the three ion sources around the quadrupole deflector 81 and controlling the voltages applied to the electrodes of the quadrupole deflector 81. However, in this case, there occurs a problem that the ion source not selected is contaminated by ions emitted from the other ion source. In such a case, if the ion acceleration voltage applied to the ion sources other than the ion source (the ion source selected) emitting the ions being mass analyzed is blocked, ions are not emitted from the ion sources and accordingly the other ion sources are not contaminated.

As having been described above, in the present invention, the various kinds of a plurality of ion sources are connected to one MS, and measurements can be performed using the ion sources at a time. Therefore, according to the present invention, measurements of the LC/MS, the GC/MS and the plasma ionization MS are performed using one MS at a time.

Switching of the ion source in the present invention can be widely applied to a quadrupole mass analyzer, an ion trap mass analyzer, a magnetic field type mass analyzer, a time-of-flight mass analyzer and the like.

Further, most kinds of the ion sources already used for mass spectrometers can be used for the present invention. That is, in addition to the ESI, the APCI, the EI, the CI, the ICP and the MIP, the laser ionization ion source, the FAB ion source, the secondary ionization (SIMS) ion source (all of these three ion sources are operated under a high vacuum), the glow discharge ion source and so on are widely used in the field of mass analysis. Some of these ion sources applicable to the present invention are operated under atmospheric pressure, and the others are operated under a high vacuum. All of them can be used in combination by the methods described above.

According to the present invention, in an LC/MS, a GC/MS, a plasma ionization MS or the like which comprises a plurality of ion sources, it is possible to perform mass analysis while the plurality of ion sources are being operated. Further, in the present invention, since ions introduced into the mass spectrometer can be easily and speedily switched by switching voltage applied to the ion acceleration electrode or the quadrupole deflector regardless of operation of the ion sources, the capacity of processing samples per unit time can be largely increased and accordingly an apparatus having a high throughput can be obtained.

Further, since analyses of a plurality of ion sources can be performed by one mass spectrometer, the apparatus can be made small in size and low in cost.

What is claimed:

1. A mass analysis apparatus for performing mass analysis by introducing ions produced in an ion source into a mass spectrometer, which comprises:

a plurality of ion sources; and a deflecting means for deflecting ions from at least one ion source among said plurality of ion sources so that the ions travel toward said mass spectrometer by an electrostatic field, wherein said deflecting means is a quadrupole deflector which is composed of four electrodes.

2. A mass analysis apparatus according to claim 1, wherein said quadrupole deflector selectively introduces ions of one of said ion sources into the mass spectrometer by switching voltage applied to each of said electrodes.

3. A mass analysis apparatus according to claim 1, which comprises an ion trap portion for trapping incident ions, wherein said mass spectrometer, said ion trapping portion and said quadrupole deflector are arranged on a single axis.

4. A mass analysis apparatus according to claim 3, wherein said quadrupole deflector and said two ion sources are arranged on a single axis, and the arrangement axis formed by said quadrupole deflector and said two ion sources is arranged so as to intersect at a center of said quadrupole deflector at right angle with an arrangement axis including said mass spectrometer and said ion trapping portion.

5. A mass analysis apparatus according to claim 1, wherein said mass spectrometer, said quadrupole deflector and one of said ion sources are arranged on a single axis, and said quadrupole deflector and said two ion sources are arranged on a single axis, the arrangement axis formed by said quadrupole deflector and said two ion sources being arranged so as to intersect at a center of said quadrupole deflector at right angle with an arrangement axis including said mass spectrometer and arbitrary one of said ion sources.

6. A mass analysis method of a mass analysis with apparatus comprising a quadruple deflector composed of four electrode members for performing a measurement by selectively introducing ions from a plurality of ion sources into a mass spectrometer for mass-separating the ions from said ion source, each of said ion sources being arranged at a position where ions can be introduced into a gap between the electrode members of said quadruple deflector, the mass analysis method comprising:

ionizing said ions in respective ones of said ion sources and introducing said ions from said ion sources into said quadruple deflector;

a first deflecting in which a first pair composed of two electrode members of said quadruple deflector opposite to each other is set to a high voltage and a second pair composed of the other two electrode members is set to a voltage lower than the voltage of said first pair;

a second deflecting in which said first pair is set to a lower than the voltage of said second pair; and mass-separating said ions introduced from said quadruple deflector into said mass spectrometer.

7. A mass analysis method for mass analysis according to claim 6, wherein said first deflecting and said second deflecting are continuously switched, and a period of switching between said first and second deflecting is performed in synchronism with a period of mass sweeping of said mass spectrometer.

8. A mass analysis method for mass analysis according to claim 6, wherein switching between said first deflecting and said second deflecting is performed while said mass spectrometer is measuring an ion current to an arbitrary mass number.

9. A mass analysis method for mass analysis according to claim 6, which further comprises:

a third deflecting in which all the four electrodes of said quadruple deflector are set to an equal voltage.

10. A mass analysis method for mass analysis according to claim 6, wherein said plurality of ion sources emit ions to said quadruple deflector during the same period.

* * * * *